US005660539A

United States Patent [19]

Matsunaga et al.

[11] Patent Number: 5,660,539

[45] Date of Patent: Aug. 26, 1997

[54] SCROLL COMPRESSOR

[75] Inventors: Mutsunori Matsunaga; Takao Mizuno, both of Shimizu; Kenji Tojo, Ibaraki-ken; Hideyuki Ueda; Takeshi Hida, both of Shimizu, all of Japan

[73] Assignee: Hitachi, Ltd., Tokyo, Japan

[21] Appl. No.: 547,357

[22] Filed: Oct. 24, 1995

[30] Foreign Application Priority Data

Oct. 24, 1994 [JP] Japan ..... 6-258308
Mar. 20, 1995 [JP] Japan ..... 7-060373

[51] Int. Cl.[6] ..... F01C 1/04

[52] U.S. Cl. ..... 418/55.6; 418/55.4; 418/55.5; 418/94; 184/6.18

[58] Field of Search ..... 418/55.4, 55.5, 418/55.6, 91, 94; 184/6.18

[56] References Cited

U.S. PATENT DOCUMENTS

| | | | |
|---|---|---|---|
| 4,502,852 | 3/1985 | Hazaki | 418/94 |
| 4,666,381 | 5/1987 | Butterworth | 418/55.6 |
| 4,792,296 | 12/1988 | Kobayashi et al. | 418/55.6 |
| 5,439,361 | 8/1995 | Reynolds et al. | 418/55.6 |
| 5,505,596 | 4/1996 | Nakamura et al. | 418/94 |

FOREIGN PATENT DOCUMENTS

| | | |
|---|---|---|
| 60-224988 | 11/1985 | Japan . |
| 62-37238 | 8/1987 | Japan . |

*Primary Examiner*—Charles G. Freay

*Attorney, Agent, or Firm*—Antonelli, Terry, Stout & Kraus, LLP

[57] ABSTRACT

A lubricating construction of a scroll compressor includes a seal member provided between an orbiting scroll and a main frame to isolate a back pressure chamber from bearing portions to thereby keep the bearing portions substantially under a discharge pressure, a first oil feed passage extending from a lubricating oil portion under the discharge pressure to a space, disposed adjacent to an end of a crank portion of the crankshaft, through the crankshaft, a second oil feed passage extending from the above space to be opened to sliding portions of end plates of the orbiting and stationary scrolls through the end plate of the orbiting scroll, and communicating with the back pressure chamber, and a third oil feed passage extending from midway the first oil feed passage to be opened to an outer peripheral surface of the crankshaft, and serving to supply a lubricating oil to a main bearing portion by the use of a centrifugal pumping action produced by rotation of the crankshaft. The second oil feed passage has midway a throttle portion of a reduced flow passage area. This lubrication construction supplies the lubricating oil, using the pressure differential and the pumping action in combination.

17 Claims, 12 Drawing Sheets

SCROLL COMPRESSOR

BACKGROUND OF THE INVENTION

This invention relates Generally to a scroll compressor suited for use as a cooling medium compressor for freezing or air-conditioning purposes and a gas (e.g. air) compressor, and more particularly to a lubricating construction of such a compressor.

Japanese Patent Unexamined Publication No. 60-224988 discloses a lubricating construction of a scroll compressor including a stationary (fixed) scroll and an orbiting scroll, and a seal member provided at a rear side of the orbiting scroll to keep a bearing portion, provided at a central portion of the compressor, at a discharge pressure. In this construction, the interior of a sealed vessel is kept at the discharge pressure, and a crankshaft and bearing portions are disposed in an atmosphere of the discharge pressure, and the bearing portions are lubricated by a centrifugal pumping action caused by an eccentric hole formed in the crankshaft. Lubricating oil, after supplied to each bearing portion, is circulated under the discharge pressure within the sealed vessel.

In the conventional construction in which the lubricating oil is supplied to the bearing portions by the eccentric hole formed in the crankshaft, the lubricating oil is filled in the eccentric hole in the rotating crankshaft, thereby achieving the centrifugal pumping action. Therefore, this construction has been used only in scroll compressors of the vertical type in which the axis of the crankshaft is disposed vertically.

Generally, scroll compressors are of the vertical type in which a compression mechanism portion is disposed at an upper portion, and an electric motor portion is disposed at a lower portion. In order to obtain a pumping capacity of a centrifugal pump necessary for lubricating a bearing portion disposed at a upper portion of a crankshaft, it is necessary that a oil feed passage formed in the crankshaft be eccentric a predetermined amount from the axis of the crankshaft, and therefore it has been necessary to increase the outer diameter of the crankshaft in order to obtain the required centrifugal pumping capacity. Particularly when the scroll compressor is of the variable-speed type, there has been encountered a problem that a sufficient eccentricity amount capable of securing the necessary centrifugal pumping capacity during a low-speed operation can not be obtained because of the limited outer diameter of the crankshaft, thus limiting the low-speed operation range.

Japanese Patent Publication No. 62-37238 discloses another conventional construction in which gas pressure acts on a back pressure chamber at a rear side of an orbiting scroll to impart an axial urging force to the orbiting scroll, thereby preventing the orbiting scroll from being disengaged from a stationary scroll.

The back pressure chamber is sealed from a closed vessel by means of a frame, the crankshaft, a seal bearing mounted on the frame to support the crankshaft, and so on with respect to the pressure. Through a small hole formed in the orbiting scroll, the back pressure chamber communicates with a compression space in the process of being compressed, and therefore in accordance with a change in intake pressure, the back pressure chamber is kept to a pressure intermediate the suction pressure and the discharge pressure. Lubricating oil, supplied to the seal bearing, flows into the back pressure chamber, and then passes through the small hole in the orbiting scroll into the compression space to be mixed with the compressed gas there, and then is discharged to a space in a closed vessel. The lubricating oil is basically separated from the discharge gas in the closed vessel, but the lubricating oil not separated from the discharge gas is fed, together with the discharge gas, through a discharge pipe to a place where the gas is to be used. This phenomenon is called "oil shortage". Particularly when it is desired to design the compressor of a small size, a sufficient space for separating the oil from the gas can not be secured in the closed vessel, and therefore a sufficient separation can not be carried out, so that the amount of oil shortage increases.

The seal bearing seals the back pressure chamber with respect to pressure, and therefore one side of the seal bearing directed toward the space in the closed vessel is under the discharge pressure while the other side directed toward the back pressure chamber is at the pressure in the back pressure chamber (that is, the pressure intermediate the suction pressure and the discharge pressure; this pressure will hereinafter be referred to as "intermediate pressure"). Therefore, a pressure gradient from the discharge pressure to the intermediate pressure is produced in the heightwise direction of the seal bearing. When part of the lubricating oil, supplied to the seal bearing, flows into the back pressure chamber, the cooling medium dissolved in the lubricating oil produces bubbles due to the pressure reduction caused by this pressure gradient. When such pressure-reduction bubbles develop in the cooling medium, an oil film formed on the seal bearing breaks, so that the bearing can not perform the intended function, and therefore can not withstand a bearing load, which may results in seizure of the bearing.

The lubricating oil having flowed into the back pressure chamber flows through the small hole into the compression space in the course of compression to be mixed with the compressed gas therein. Since the lubricating oil of a temperature close to the discharge temperature is thus included in the gas in the course of compression, the temperature of the compressed gas rises. Namely, the compression work must be increased corresponding to this temperature rise, so that the compression efficiency is lowered. And besides, the lubricating oil mixed in the discharge gas must be separated therefrom in the closed vessel.

SUMMARY OF THE INVENTION

It is an object of this invention to provide a scroll compressor in which a lubricating oil can be positively supplied to bearing portions even during a low-speed operation of the compressor.

Another object of the present invention is to provide a scroll compressor in which a lubricating capacity can be enhanced without the need of making a crankshaft thicker.

A further object of the present invention is to provide a horizontal-type scroll compressor with a horizontally-disposed crankshaft, in which a lubricating oil can be positively supplied to bearing portions.

A still further object of the invention is to provide a scroll compressor, in which an orbiting scroll is supported by an intermediate pressure in a back pressure chamber provided at a rear side of the orbiting scroll, and the reliability of a bearing is high, and a lubricating oil is prevented from being mixed in a compression gas in the course of compression, thereby preventing the efficiency from being lowered, and an amount of the lubricating oil mixed in the discharge gas (that is, a level of oil shortage) is reduced.

According to a first aspect of the present invention, there is provided a scroll compressor comprising:

a compression mechanism comprising a stationary scroll, an orbiting scroll, a crankshaft for revolving the orbiting scroll, and a main frame supporting the crankshaft through a main bearing portion;

a closed vessel containing the compression mechanism therein, adapted to be kept at a discharge pressure, and having a lubricating oil portion;

a first oil feed passage extending from the lubricating oil portion under the discharge pressure to a space, disposed adjacent to a distal end of a crank portion of the crankshaft, through the crankshaft;

a second oil feed passage extending from the space to a lower pressure portion through an end plate of the orbiting scroll, and having midway a throttle portion of a reduced flow passage area; and a third oil feed passage extending from midway the first oil feed passage to be opened to an outer peripheral surface of the crankshaft, and serving to supply a lubricating oil to the main bearing portion by the use of a centrifugal pumping action produced by the rotation of the crankshaft.

According to a second aspect of the invention, there is provided a scroll compressor comprising:

a compression mechanism comprising a stationary scroll having a lap, an orbiting scroll having a lap, a compression chamber formed by engagement of said laps, a crankshaft for revolving the orbiting scroll through an orbiting bearing portion, and a main frame supporting the crankshaft through a main bearing portion;

an electric motor portion for driving the compression mechanism;

a closed vessel containing the compression mechanism and the electric motor portion therein, adapted to be kept at a discharge pressure, and having a lubricating oil portion;

a first oil feed passage extending from the lubricating oil portion under the discharge pressure to a space, disposed adjacent to a distal end of a crank portion of the crankshaft, through the crankshaft; and a second oil feed passage extending from the space to be opened to sliding portions of end plates of the orbiting and stationary scrolls through the end plate of the orbiting scroll, and communicating with a lower pressure portion, said second oil feed passage having midway a throttle portion of a reduced flow passage area; and a third oil feed passage extending from midway the first oil feed passage to be opened to an outer peripheral surface of the crankshaft, and serving to supply a lubricating oil to the main bearing portion by the use of a centrifugal pumping action produced by the rotation of the crankshaft.

According to a third aspect of the invention, there is provided a scroll compressor comprising:

a compression mechanism comprising a stationary scroll having an end plate and a lap of a spiral configuration provided upright on the end plate, an orbiting scroll having an end plate and a lap of a spiral configuration provided upright on the end plate, a compression chamber defined by engagement of said stationary scroll and said orbiting scroll with said laps inside, a crankshaft for revolving the orbiting scroll through an orbiting bearing portion, and a main frame supporting the crankshaft through a main bearing portion;

an electric motor portion for driving the compression mechanism;

a closed vessel containing the compression mechanism and the electric motor portion therein, communicating with a discharge port of the compression mechanism to be kept at a discharge pressure, and having a lubricating oil portion provided at a lower end portion thereof;

a back pressure chamber defined by the orbiting scroll, the stationary scroll and the main frame to be disposed at a rear side of the orbiting scroll, and being kept at a pressure intermediate the discharge pressure and a suction pressure;

a seal member provided between the orbiting scroll and the main frame to isolate the back pressure chamber from the bearing portions, thereby keeping the bearing portions substantially under the discharge pressure;

a first oil feed passage extending from the lubricating oil portion under the discharge pressure to a space, disposed adjacent to a distal end of a crank portion of the crankshaft, through the crankshaft; and a second oil feed passage extending from the space to be opened to sliding portions of the end plates of the orbiting and stationary scrolls through the end plate of the orbiting scroll, and further communicating with the back pressure chamber, the second oil feed passage having midway a throttle portion of a reduced flow passage area; and a third oil feed passage extending from midway the first oil feed passage to be opened to an outer peripheral surface of the crankshaft, and serving to supply a lubricating oil to the main bearing portion by the use of a centrifugal pumping action produced by the rotation of the crankshaft.

According to a fourth aspect of the invention, there is provided a scroll compressor of the horizontal type comprising:

a stationary scroll;

an orbiting scroll;

a horizontally extending crankshaft for revolving the orbiting scroll;

a main frame supporting a portion of the crankshaft toward a crank through a main bearing portion;

a closed vessel containing the two scrolls, the crankshaft, the main frame and the main bearing portion therein, adapted to be kept at a discharge pressure, and having a lubricating oil portion;

an auxiliary bearing portion mounted on the closed vessel, and supporting an end portion of the crankshaft opposite to the crank portion;

a first oil feed passage extending from the lubricating oil portion under the discharge pressure to a space, disposed adjacent to a distal end of the crank, through an oil feed pipe, mounted on the closed vessel, and an oil feed passage formed in the crankshaft;

a second oil feed passage extending from the space to a lower pressure portion through an end plate of the orbiting scroll, and having midway a throttle portion of a reduced flow passage area;

a third oil feed passage extending from midway the first oil feed passage to be opened to an outer peripheral surface of the crankshaft, and serving to supply a lubricating oil to the main bearing portion by the use of a centrifugal pumping action produced by the rotation of the crankshaft; and a fourth oil feed passage extending from midway the first oil feed passage to be opened to the outer peripheral surface of the crankshaft, and serving to supply the lubricating oil to the auxiliary bearing portion by the use of the centrifugal pumping action produced by the rotation of the crankshaft.

Preferably, the throttle portion is defined by sliding surfaces of the end plates of the orbiting scroll and the stationary scroll, to which the oil feed passage portion of the second oil feed passage formed in the end plate of the orbiting scroll is opened.

Preferably, a groove passage is formed generally circumferentially in that area of the sliding surface of the stationary scroll end plate, in which the open end of the oil feed passage portion, formed in the orbiting scroll, moves upon the revolution of the orbiting scroll, so that the open end of the oil feed passage portion intermittently can communicate with the groove passage upon the revolution of the orbiting scroll.

Preferably, a portion of the first oil feed passage formed in the crankshaft is inclined relative to an axis of the crankshaft in such a manner that it is disposed substantially in the axis of the crankshaft at its upstream side, and is eccentric from the axis of the crankshaft at its downstream side.

Preferably, there is provided an auxiliary bearing portion which supports an end portion of the crankshaft opposite to the crank portion disposed adjacent to the main bearing portion, and there is provided a fourth oil feed passage which extends from midway the first oil feed passage to be opened to the outer peripheral surface of the crankshaft, and serving to supply the lubricating oil to the auxiliary bearing portion by the use of the centrifugal pumping action produced by the rotation of the crankshaft.

Preferably, an oil discharge hole is formed in the main frame to communicate a first space, formed between the orbiting bearing portion and the main bearing portion, with a second space in the closed vessel so as to discharge the lubricating oil, supplied to the first space, to the second space in the closed vessel.

The scroll compressors having the above features achieve the following effects.

The scroll compression mechanism is housed in the closed vessel to keep the same at the discharge pressure, and the back pressure chamber is formed at the rear side of the orbiting scroll by the stationary scroll, the orbiting scroll and the main frame. The back pressure chamber is divided by the seal member, provided between the orbiting scroll and the main frame, into the bearing portions and the back pressure chamber disposed outside of the bearing portions. Therefore, the bearing portions are kept under the pressure generally equal to the discharge pressure while the back pressure chamber outside of the seal member is kept at the pressure intermediate the suction pressure and the discharge pressure by the intermediate hole communicating with the compression chamber.

The lubricating oil portion under the discharge pressure in the closed vessel communicates with the back pressure chamber under the intermediate pressure through the first and second oil feed passages, thus forming a pressure differential oil feed passage. The main bearing portion is lubricated by means of the third oil feed passage radially branching off from the oil feed passage in the crankshaft.

The throttle portion provided at the second oil feed passage is sufficiently smaller in flow area than the first oil feed passage formed in the crankshaft, and the pressure of the lubricating oil in the oil feed passage in the crankshaft is kept substantially at the discharge pressure.

The lubricating oil, supplied to the sliding surfaces of the orbiting scroll end plate and the stationary scroll end plate by the pressure differential through the second oil feed passage, flows into the back pressure chamber to lubricate a sliding surface of an Oldham ring provided in the back pressure chamber.

When the oil feed passage in the crankshaft is eccentric toward the crank portion with respect to the axis of the crankshaft, the eccentric oil feed passage can be formed without increasing the diameter of the crankshaft. With this construction, the lubricating oil, flowing through the oil feed passage in the crankshaft, is increased in pressure by the centrifugal pumping action. The pressure of the lubricating oil in the third and fourth oil feed passages can also be increased by the centrifugal pumping action.

In the horizontal-type scroll compressor in which the crankshaft is disposed horizontally, and the crankshaft and the respective bearing portions are disposed in the atmosphere of the discharge pressure, the lubricating oil portion under the discharge pressure in the closed vessel communicates with the back pressure chamber kept at the pressure intermediate the discharge pressure and the suction pressure, thus forming the pressure differential oil feed passage, and therefore the lubrication oil can be supplied using the pressure-differential lubrication and the centrifugal lubrication in combination, so that the lubricating oil can be positively supplied.

According to a fifth aspect of the invention, there is provided a scroll compressor comprising a scroll compression mechanism housed in a closed vessel to have a discharge port communicated to a space in the closed vessel to thereby keep an interior of the closed vessel at a discharge pressure, a back pressure chamber formed by an orbiting scroll, a stationary scroll and a frame to be disposed on an opposite side of the orbiting scroll to a lap thereof, and a seal member provided between the orbiting scroll and the frame to divide the back pressure chamber into a first space disposed at a central portion to be kept at a pressure generally equal to a discharge pressure and a second space disposed at an outer peripheral portion of the back pressure chambers to be kept at a pressure intermediate a suction pressure and the discharge pressure through a communication passage with a compression space in the course of compressing.

In one preferred form of the invention, an oil feed passage is formed in a crankshaft to be opened to the first space so as to feed a lubricating oil, stored in a bottom portion of the closed vessel, into the first space, and there is provided an oil discharge passage which permits the lubricating oil to be discharged from the first space into a space in the closed vessel. In another preferred form of the invention, an oil discharge pipe is connected to the oil discharge passage so as to rapidly return the lubricating oil to the bottom portion of the closed vessel or a partition plate for shutting off a flow of gas in the closed vessel is provided on an inner wall of the closed vessel at such a position that an open end of the oil discharge passage is directed toward the partition wall. In the conventional construction, the lubricating oil in the back pressure chamber is fed into the compression space to be mixed with the compressed gas. In the present invention, however, the lubricating oil can be returned to the oil reservoir at the bottom portion of the closed vessel without being mixed with the compressed gas.

The scroll compressor having the above features can achieve the following effects.

Since the pressure within the first space is substantially equal to the discharge pressure, there develops no pressure gradient in the bearing, and therefore the cooling medium dissolved in the lubricating oil will not produce bubbles due to the pressure reduction. Therefore, an oil film on the bearing will not break, thus achieving a high reliability.

A small proportion of the lubricating oil, having flowed into the first space, leaks past the seal member into the second space to lubricate an Oldham ring and so on, and the remainder of the lubricating oil is discharged to the space in the closed vessel via the oil discharge hole and the oil discharge passage. Therefore, the lubricating oil will hardly be mixed in the compressed gas in the compression space through the small hole in the orbiting scroll. Therefore, the temperature of the compressed gas is prevented from being raised by the lubricating oil, thereby preventing reduction of compression efficiency, and also the lubricating oil is not mixed in the gas in the course of compression. And besides, the lubricating oil, discharged via the oil discharge pipe or the partition plate, will not be mixed with the discharge gas in the space in the closed vessel, and therefore an oil separation mechanism for separating the oil from the discharge gas is dispensed with, and a level of oil shortage can be kept to a low level.

DESCRIPTION OF THE PREFERRED EMBODIMENTS

A preferred embodiment of a scroll compressor of the present invention will now be described with reference to the drawings.

Figure 1:
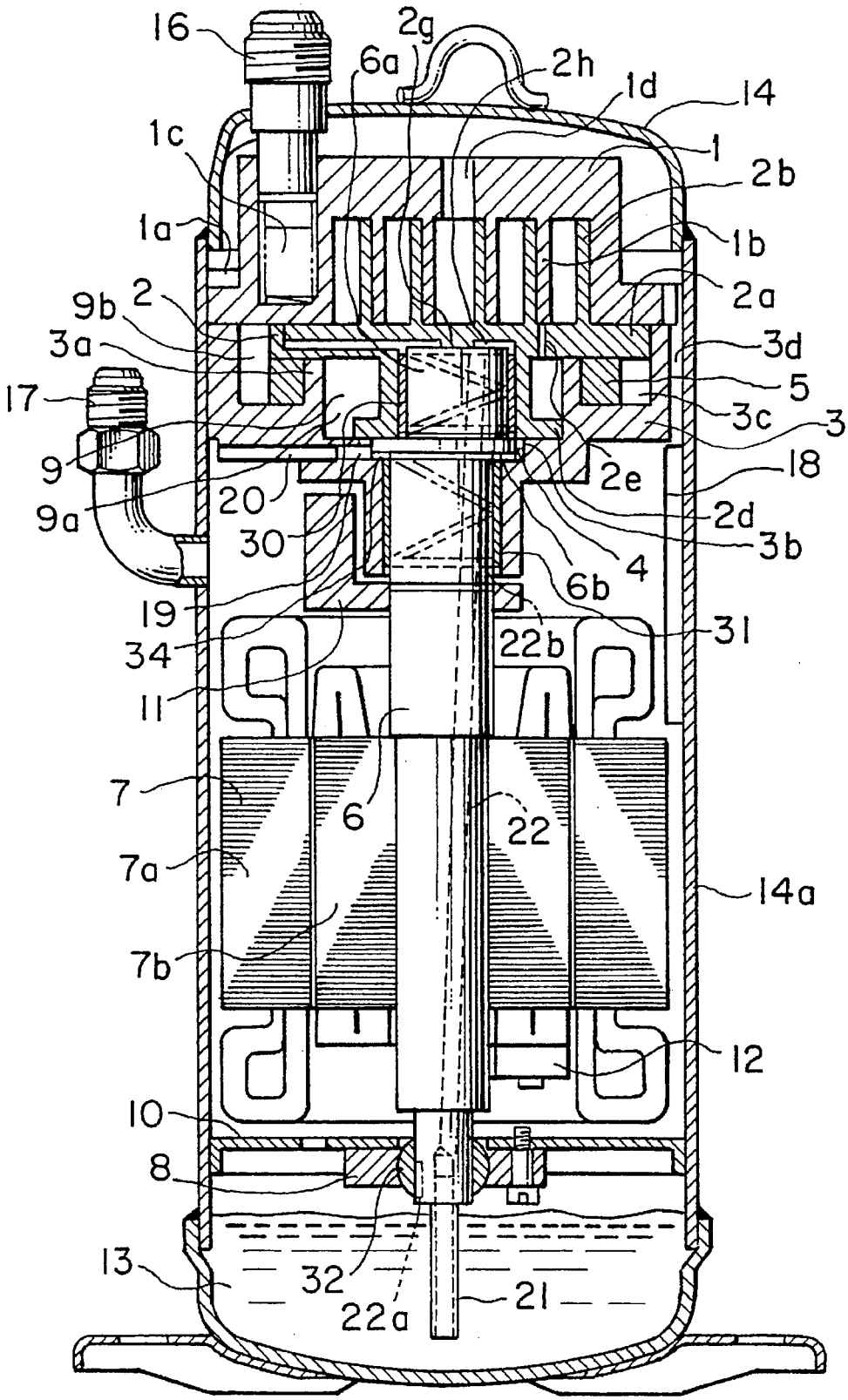
FIG. 1 is a vertical cross-sectional view of a preferred embodiment of a scroll compressor of the present invention.
Figure 2:
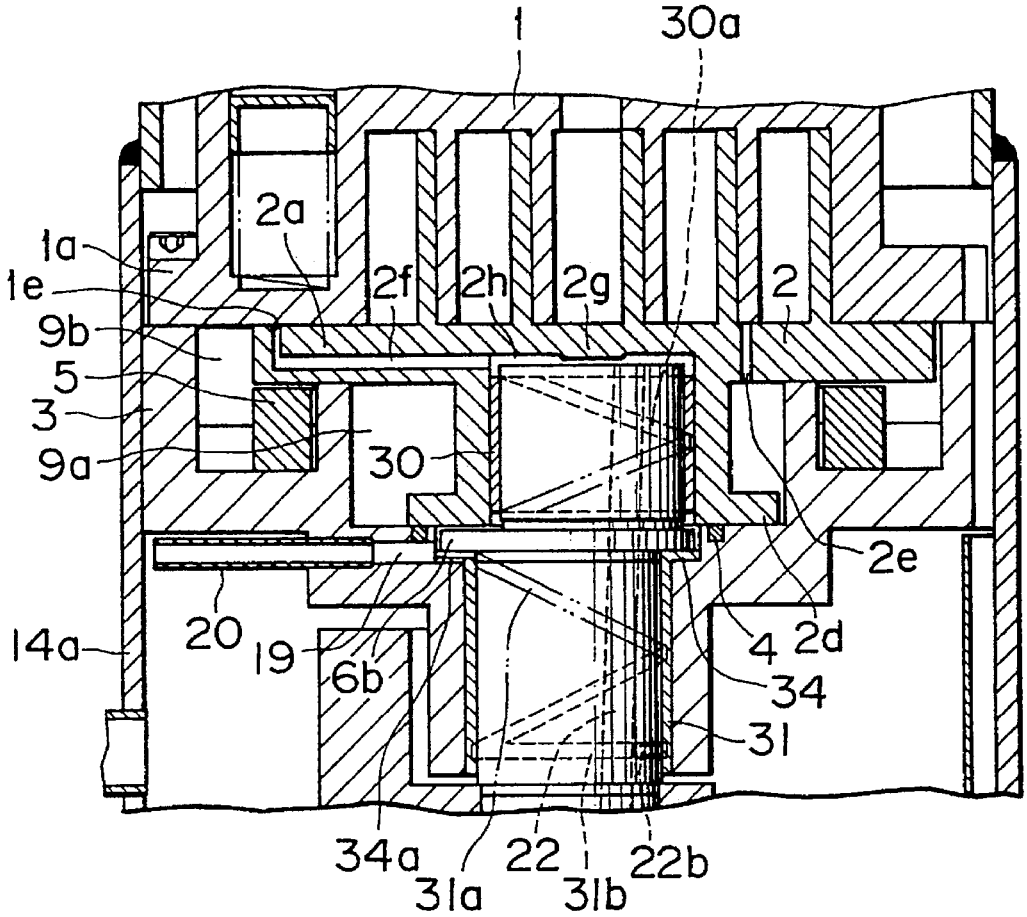
FIG. 2 is an enlarged view of an essential portion of the scroll compressor shown in FIG. 1.

FIGS. 1 and 2 show a vertical-type scroll compressor of the invention. In these Figures, a stationary (fixed) scroll 1 includes an end plate 1*a*, and a lap 1*b* of a spiral configuration provided upright on the end plate 1*a*. The stationary scroll 1 also has a suction port 1*c* at an outer peripheral portion of the lap, and a discharge port 1*d* at a central portion of the lap. An orbiting scroll 2 includes an orbiting scroll end plate 2*a*, and a lap 2*b* of a spiral configuration provided upright on the end plate 2*a*, and the orbiting scroll 2 has an orbital bearing portion 30 provided at a rear side of the lap 2*b* at a central portion thereof. The stationary scroll 1 and the orbiting scroll 2 are connected together, with the laps 1*b* and 2*b* engaged with each other to form a compression chamber. An intermediate hole (small hole) 2*e* of a small diameter is formed through that portion of the end plate 2*a* close to a side or peripheral surface of the lap 2*b*, and this intermediate hole 2*e* communicates the compression chamber with a back pressure chamber 9 provided at the rear side of the orbiting scroll 2. A gas passage 3*d* is formed in an outer side or peripheral surface of a main frame 3, and the stationary scroll 1 is fixedly secured to the main frame 3 by a plurality of bolts, so that the orbiting scroll end plate 2*a* is held between the stationary scroll 1 and a pedestal 3*a* of the main frame 3. A main bearing portion 31 bearing a crankshaft 6 is provided at a central portion of the main frame 3. The back pressure chamber 9 is formed by the rear surface of the orbiting scroll 2 and the main frame 3. The back pressure chamber 9 is divided by the main frame pedestal 3*a* of a hollow cylindrical construction into two spaces, that is, an inner space 9*a* and an outer space 9*b*, and the two spaces 9*a* and 9*b* communicate with each other through a gap between the rear surface of the orbiting scroll 2 and the pedestal 3*a*. The inner space 9*a* of the back pressure chamber 9 communicates with the compression chamber through the intermediate hole 2*e*. A seal member 4 is held in a ring-shaped groove 3*b* formed in the main frame 3 to be disposed between the back pressure chamber 9 and the main bearing portion 31. A flange 2*d* of the orbiting scroll 2, which has a smooth surface, is held in sliding contact with the seal member 4. An oil discharge hole 19 is formed in the main frame 3 to be disposed between the seal member 4 and the main bearing portion 31, the oil discharge hole 19 communicating with a lower space below the main frame 3. An oil discharge pipe 20 is connected to the oil discharge hole 19.

The seal member 4 is in the form of a seal ring made, for example, of fluoroplastics such as tetrafluoroethylene or a polyimide resin, and the seal member 4 needs only to achieve a necessary sealing effect within the compressor during the operation. Although one seal member is shown, a plurality of seal members may be used in order to enhance the sealing effect.

An Oldham ring 5 is provided in the outer space 9*b* of the back pressure chamber 9 to prevent the orbiting scroll 2 from rotating about its axis relative to the stationary scroll 1. The Oldham ring 5 has two pairs of perpendicularly-arranged keys which are engaged in a pair of keyways (not shown), formed in the end plate 2*a* of the orbital scroll 2, and a pair of keyways formed in the outer surface of the pedestal 3*a* of the main frame 3. The crankshaft 6 is supported by the main bearing portion 31 and a lower auxiliary bearing portion 32 between which an electric motor 7 is disposed, and the auxiliary bearing portion 32 is mounted on a barrel portion 14*a* of a closed vessel 14 through an auxiliary frame 8.

The crankshaft 6 has an oil feed passage 22 formed therein, and is inclined with respect to the axis of rotation of the crankshaft 6 in a direction of eccentricity of a crank portion 6*a*. The oil feed passage 22 is open at its upper end to an upper end surface of the crank portion 6*a*, and the lower end of the oil feed passage 22 is open through an oil feed pipe 21 to a lubricating oil portion at a lower portion of the closed vessel 14. The oil feed passage 22 and the oil feed pipe 21 jointly constitute a first oil feed passage. An oil feed passage (third oil feed passage) 22*b* branches off from the oil feed passage 22 to extend radially of the crankshaft toward the lower end portion of the main bearing portion 31. Lubricating oil, stored in the lower end portion of the closed vessel 14, is supplied to the main bearing portion 31 via the first and third passages. The orbiting scroll 2 is supported on the crank portion 6*a* of the crankshaft 6 through the orbiting bearing portion 30, and the lubricating oil is supplied to the orbiting bearing member 30 via the first oil feed passage 21, 22, utilizing a space 2h disposed immediately above the upper end surface of the crank portion 6a. The lubricating oil, supplied to the space adjacent to the upper end of the crankshaft, is distributed over the entire area of the bearing portion 30 through a spiral groove 30a formed in the inner peripheral surface of the bearing portion 30, and then the lubricating oil lubricates a thrust receiving portion 6b which is formed integral with the crankshaft 6, and is disposed in a space below the bearing portion 30, and then the lubricating oil is returned via the oil discharge hole 19 and the oil discharge pipe 20 to the lubricating oil portion at the lower portion of the closed vessel 14.

The electric motor 7 comprises a motor stator 7a, and a motor rotor 7b fixedly mounted on the crankshaft 6. An auxiliary frame support member 10 is mounted on the barrel portion 14a of the closed vessel 14, and the auxiliary frame 8 is fixedly secured to this support member 10 by a plurality of bolts in such a manner that the position of the auxiliary frame 8 can be adjusted in the radial direction, and with this arrangement the axis of the auxiliary bearing portion 32, fixedly mounted on the auxiliary frame 8, can be aligned with the axis of the main bearing portion 31. An inner surface of the auxiliary bearing portion 32 is formed into a slide bearing surface, and this bearing portion 32 has a generally spherical outer surface, and is fitted in a housing of the auxiliary frame 8 having a generally spherical inner surface. Thus, the auxiliary bearing portion 32 has an aligning function. The lubricating oil is supplied to the auxiliary bearing portion 32 through a fourth oil feed passage 22a branching off radially from the first oil feed passage 22.

A main balance weight 11 is press-fitted on the crankshaft 6 to be disposed above the electric motor 7. An auxiliary balance weight 12 is fixedly mounted on the motor rotor 7b. The lubricating oil portion 13 is provided at the lower end portion of the closed vessel 14, and holds the lubricating oil therein. The interior of the closed vessel 14 is kept to a discharge pressure. The main frame 3, the motor stator 7a and the auxiliary frame support member 10 are fixedly mounted on the barrel portion 14a of the closed vessel 14.

The compressor has a suction portion 16 and a discharge portion 17 which extend through the wall of the closed vessel 14. A gas guide 18 is mounted on the closed vessel 14. The oil feed pipe 21 is press-fitted in the lower end of the crankshaft 6 at a central portion thereof to be in communication with the oil feed passage 22, and an open lower end of the oil feed pipe 21 is disposed in the lubricating oil portion 13.

As shown in FIG. 2, the first oil feed passage 22 communicates with an oil feed passage 2f, formed in the orbiting scroll end plate 2a, via the space 2h disposed immediately above the upper end of the crank portion 6a, and the oil feed passage 2f is open to the area of sliding contact between the end plate 1a of the stationary scroll 1 and the end plate 2a of the orbiting scroll 2. In accordance with the revolving motion, this open end of the oil feed passage 2f intermittently communicates with a ring-shaped groove passage 1e formed in the lower surface of the end plate 1a of the stationary scroll 1. This groove passage 1e forms a closed space since the opposed surfaces of the end plates 1a and 2a of the two scrolls 1 and 2 are held against each other.

A second oil feed passage is formed by the space 2h above the upper end of the crank portion 6a, and the space 2f which is formed in the orbiting scroll end plate 2a, and is open to the area of sliding contact between the two end plates 1a and 2a, and this second oil feed passage further communicates with the back pressure chamber 9.

The spiral oil feed groove 30a, formed in the inner peripheral surface of the orbiting bearing portion 30, is so designed as to achieve a viscous pumping action in a direction to promote the lubrication upon the rotation of the crankshaft 6.

The inner surface of the main bearing portion 31 is formed into a slide bearing surface, and a circumferential groove 31b is formed in a lower portion of this slide bearing surface to be opposed to the third oil feed passage 22b. The circumferential groove 31b communicates with the upper end surface of the bearing portion 31 through a spiral oil feed groove 31a. This spiral groove 31a is also so designed as to achieve a viscous pumping action in a direction to promote the lubrication upon the rotation of the crankshaft 6.

The crankshaft 6 is supported by a thrust bearing 34 through the thrust receiving portion 6b, the thrust bearing 34 being formed at the upper end of the main bearing portion 31. A radially-extending oil feed passage 34a is formed in a bearing surface of the thrust bearing 34 to communicate with the oil feed groove 31a in the main bearing portion 31. The oil feed groove 30a in the orbiting bearing portion 30, as well as the oil feed groove 31a in the main bearing portion 31, communicates with a space inside of the seal member 4.

The operation of the above embodiment will now be described.

When the motor rotor 7b of the electric motor 7 rotates, the orbiting scroll 2 revolves because of the provision of the Oldham ring 5, so that cooling medium gas flows through the suction portion 16 and the suction port 1c to be drawn into the compression chamber. Upon the revolving motion of the orbital scroll 2, the cooling medium gas is compressed, and is discharged through the discharge port 1d into a space above the stationary scroll 1. During this compressing operation, part of the cooling medium gas, suitably increased to a medium pressure, flows through the intermediate hole 2e into the inner space 9a of the back pressure chamber 9, thereby keeping the back pressure chamber 9 at an intermediate pressure. At the time when the compressor is activated, the orbiting scroll 2 is supported on the pedestal 3a of the main frame 3, and therefore the inner space 9a is closed, so that the pressure within the inner space 9a soon rises to a predetermined level to lift the orbiting scroll 2. Since the end plate 2a of the orbiting scroll 2 is held between the pedestal 3a of the main frame 3 and the stationary scroll 1, the orbiting scroll 2 is pressed against the stationary scroll 1 without being tilted at the time of activation, and the pressure within the outer space 9b of the back pressure chamber 9 also rises to a predetermined level.

As the operation proceeds, the pressure (discharge pressure) within the closed vessel 14 increases, and the space inside of the seal member 4 is kept at this discharge pressure. This discharge pressure inside of the seal member 4 and the pressure within the back pressure chamber 9 jointly provide a force for pressing the orbiting scroll 2 against the stationary scroll 1. This thrust force acting on the orbiting scroll 2 is larger than a total thrust force produced by the gas pressure within the compression chamber, and therefore the orbiting scroll 2 is pressed against the stationary scroll 1, so that the compressing operation is carried out in a stable manner. In order to obtain the necessary thrust force, the pressure in the back pressure chamber may be made lower while the inner diameter of the seal member 4 may be made larger.

The high-pressure gas, discharged through the discharge port 1*d* into the space above the stationary scroll 1, passes through the gas passage 3*d* in the outer side surface of the main frame 3 to flow into the space above the electric motor 7. Part of this gas passes through the gas guide 18 and a passage formed in the outer side surface of the electric motor 7 to flow into a space below the electric motor 7. Then, the gas again flows into the space above the electric motor 7. At this time, the gas cools the electric motor 7, and also the lubrication oil contained in the cooling medium gas is separated from this gas. Then, the cooling medium gas is discharged to the exterior of the compressor through the discharge portion 17. Part of the lubricating oil rises, and is discharged, together with the cooling medium gas, to the exterior of the compressor, but is returned, together with the cooling medium gas, to the inlet portion 16 of the scroll compressor. On the other hand, the separated lubricating oil flows downwardly under the influence of gravity to reach the lubricating oil portion 13 at the lower end portion of the closed vessel 14.

Because of the pressure differential between the discharge pressure and the pressure within the back pressure chamber, the lubricating oil flows from the lubricating oil portion 13 through the oil feed pipe 21, fixedly connected to the crankshaft 6, into the oil feed passage 22 in the crankshaft 6, and further flows into the oil feed passage 2*f*, formed in the orbiting scroll end plate 2*a*, through the space 2*h* above the upper end of the crankshaft 6, and further intermittently communicates with the ring-shaped groove 1*e* formed in the lower surface of the end plate 1*a* of the stationary scroll 1, thereby lubricating the opposed surfaces of the two end plates 1*a* and 2*a* held against each other. Then, the lubricating oil, thus lubricating the end plate surfaces, is discharged into the outer space 9*b*, and lubricates the Oldham ring 5 provided in this outer space 9*b*. Then, the lubricating oil flows into the inner space 9*a* through the gap between the orbiting scroll 2 and the pedestal 3*a* of the main frame 3, and further flows through the intermediate hole 2*e* into the compression chamber to be discharged, together with the cooling medium gas, through the discharge port 1*d*.

The groove passage 1*e*, formed in the lower surface of the stationary scroll end plate 1*a* forms the closed space since the opposed surfaces of the end plates 1*a* and 2*a* of the stationary and orbiting scrolls 1 and 2 are held against each other. The open end of the oil feed passage 2*f* in the orbiting scroll end plate 2*a* serves as a throttle portion of the pressure-differential oil feed passage (second oil feed passage), and since the flow passage area of this throttle portion is sufficiently smaller than the flow passage area of the oil feed passage (first oil feed passage) in the crankshaft 6, the pressure of the lubricating oil in the oil feed passage 22 in the crankshaft 6 will not decrease. The oil feed passage 22, formed in the crankshaft 6, is inclined with respect to the axis of rotation of the crankshaft 6 in the direction of eccentricity of the crank portion 6*a*, and therefore the lubricating oil, when rising in the oil feed passage 22 due to the pressure differential, is subjected to a centrifugal pumping action in the oil feed passage 22, so that the pressure of the lubricating oil increase to a level larger than the discharge pressure.

The lubricating oil is supplied to the circumferential groove 31*b* in the main bearing portion 31 via the first oil feed passage 22 and the third oil feed passage 22*b*, and further flows from this circumferential groove 31*b* through the spiral oil feed groove 31*a*, thereby lubricating the main bearing portion 31. Since the spiral groove 31*a* is so designed as to achieve the viscous pumping action in the direction to promote the lubrication upon the rotation of the crankshaft 6, the lubricating capacity can be enhanced in the bearing surface.

The thrust bearing 34 supporting the crankshaft 6 is lubricated by the lubricating oil supplied to the main bearing portion 31 since the radially-extending oil feed passage 34*a* communicates with the oil feed groove 31*a* in the main bearing portion 31. The lubricating oil, having lubricated the main bearing portion 31, reaches the space inside of the seal member 4. The auxiliary bearing portion 32 is lubricated by the lubricating oil fed through the fourth oil feed passage 22*a*, and the lubricating oil returns to the lubricating oil portion 13.

The orbiting bearing portion 30 is lubricated by the lubricating oil fed to the spiral oil feed groove 30*a* through the first oil feed passage 22 and the space 2*h* above the upper end of the crankshaft 6. Since the spiral groove 31*a* is so designed as to achieve the viscous pumping action in the direction to promote the lubrication upon the rotation of the crankshaft 6, the lubricating capacity can be enhanced in the bearing surface. The lubricating oil, having lubricated the orbiting bearing portion 30, reaches the space inside of the seal ring 4.

The lubricating oil, having lubricated the orbiting bearing portion 30 and the main bearing portion 31, reaches the space inside of the seal ring 4 to pass through the oil discharge hole 19, formed in the main frame 3, and the oil discharge pipe 20, and then drops along the inner peripheral surface of the closed vessel 14 under the influence of gravity.

Thus, the lubricating oil, having lubricated the main bearing portion 31 and the orbiting bearing portion 30, drops toward the lower end of the closed vessel 14 in a path different from the path of movement of the cooling medium gas, and therefore this lubricating oil will not flow, together with the cooling medium gas, to the exterior of the compressor, but is returned to the lubricating oil portion 13 at the lower end portion of the closed vessel 14.

A modified form of the embodiment of FIG. 1 will now be described with reference to FIGS. 3 and 4.

Figure 3:
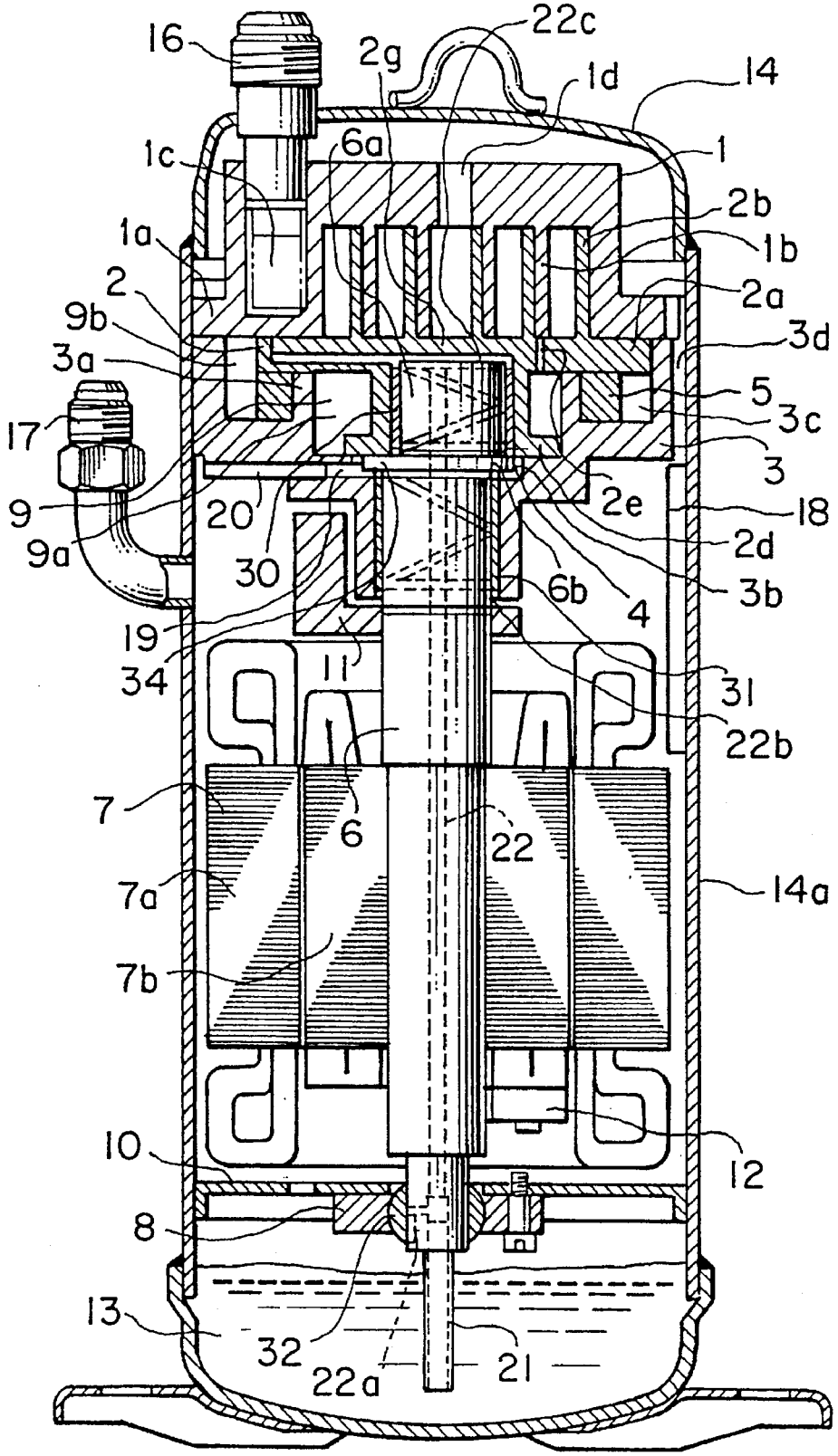
FIG. 3 is a vertical cross-sectional view of a modified form of the scroll compressor shown in FIG. 1.
Figure 4:
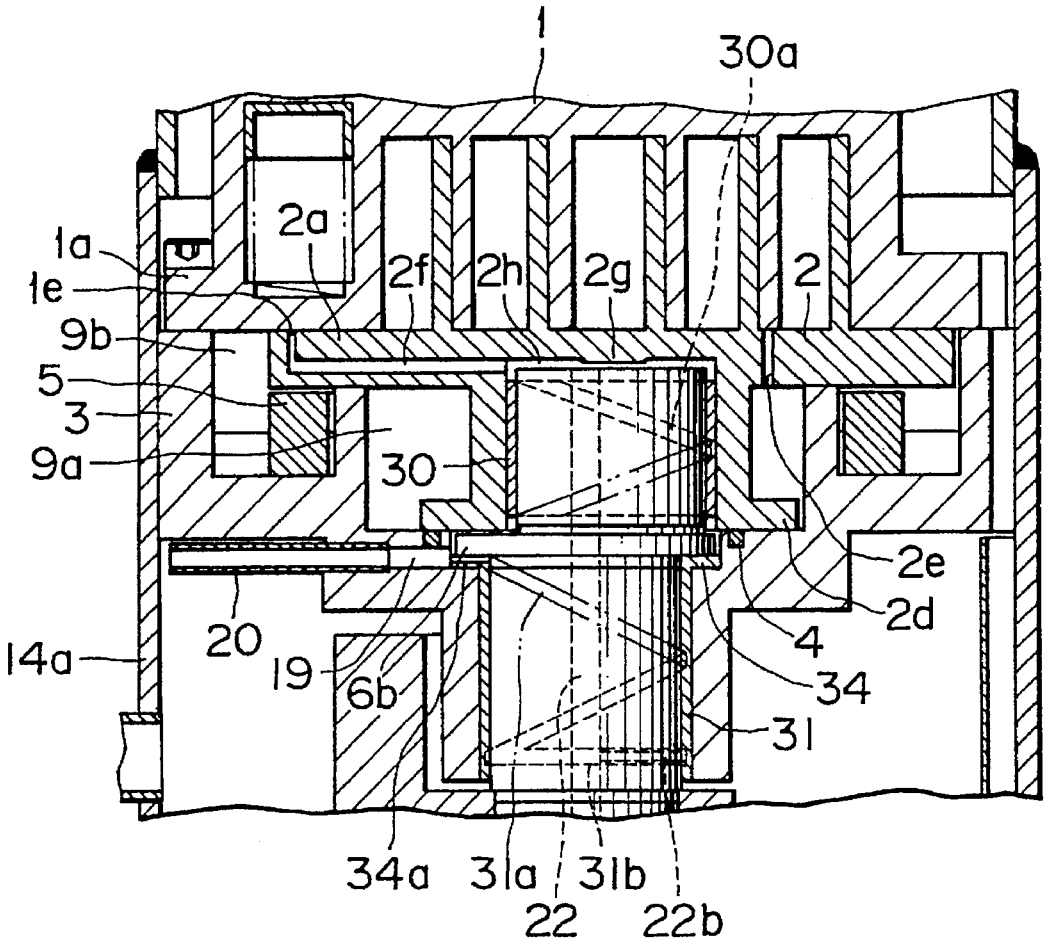
FIG. 4 is an enlarged view of an essential portion of the scroll compressor shown in FIG. 3.

This embodiment shown in FIGS. 3 and 4 differs from the embodiment of FIG. 1 in that an oil feed passage (first oil feed passage) 22, formed in a crankshaft 6, extends vertically coaxially with the crankshaft 6, and the other construction is the same as in the embodiment of FIG. 1. In this embodiment, since the oil feed passage 22 in the crankshaft 6 extends accurately along the axis of rotation of the crankshaft 6, the efficiency of production of the crankshaft 6 is enhanced.

Because of the pressure differential, a lubricating oil can be fed into the oil feed passage 22 in the crankshaft 6, and the pressure of the lubricating oil in the oil feed passage 22 can be kept at a discharge pressure, as described above for the embodiment of FIG. 1. Therefore, the lubricating oil can be fed into a third oil feed passage 22*b* and a fourth oil feed passage 22*a* which branches off radially from the oil feed passage 22. The lubricating oil in the radially-branching oil feed passages 22*a* and 22*b* is subjected to a centrifugal pumping action due to the rotation of the crankshaft 6, and therefore is supplied to bearing portions under an increased pressure. The other operation is the same as described above for the embodiment of FIG. 1.

A scroll compressor of the horizontal type according to the invention will now be described with reference to FIGS. 5 and 6. FIG. 6 is a detailed view showing an auxiliary bearing portion of the scroll compressor of FIG. 6.

Figure 5:
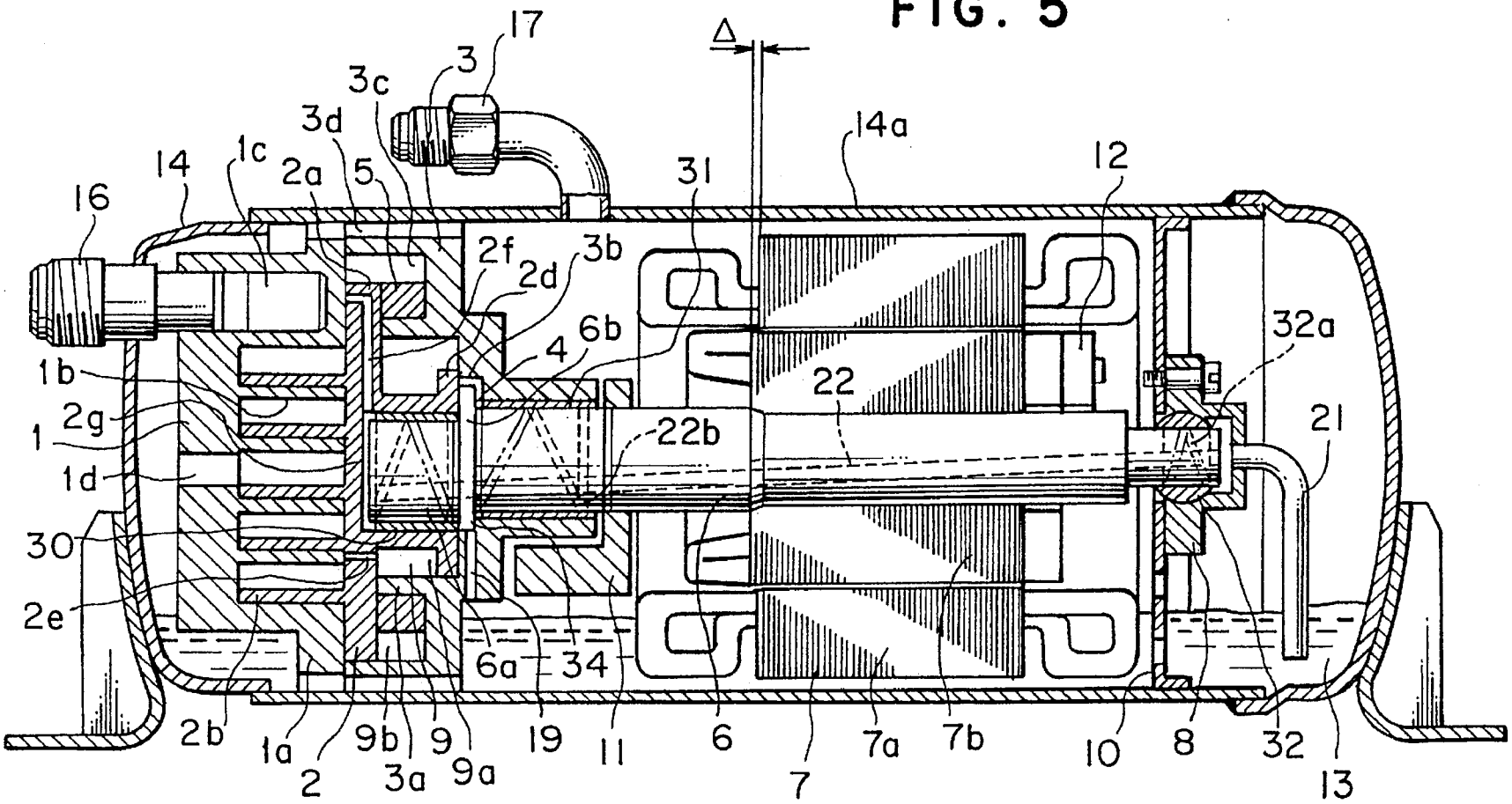
FIG. 5 is a vertical cross-sectional view of a horizontal-type scroll compressor of the invention.
Figure 6:
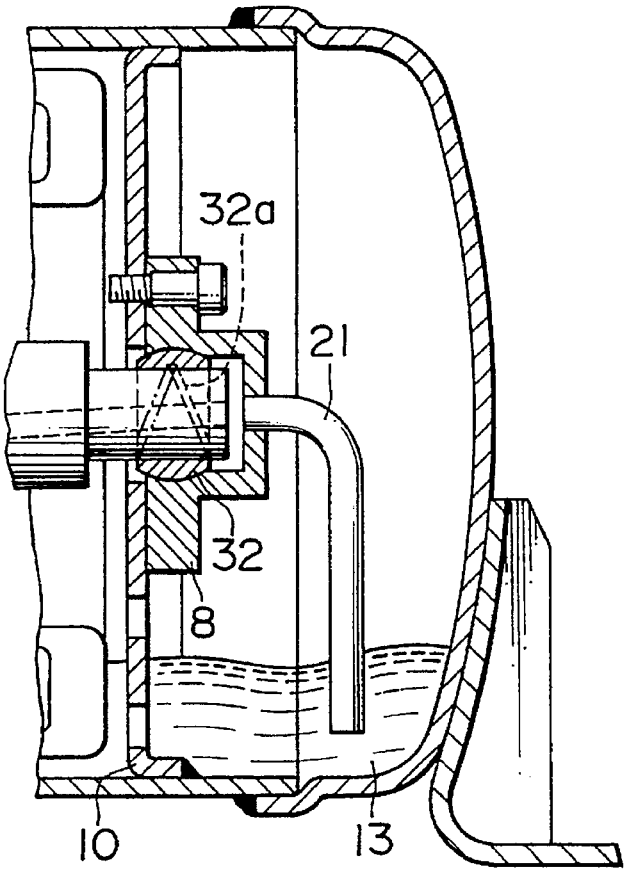
FIG. 6 is an enlarged view showing an auxiliary bearing portion in the scroll compressor shown in FIG. 5.

As shown in FIGS. 5 and 6, a crankshaft 6 is disposed horizontally, and the other construction of this embodiment is generally the same as that of the vertical-type scroll compressor of FIG. 1 except those portions described below.

In this horizontal-type scroll compressor, a motor rotor 7b is slightly offset toward a main bearing portion 31 with respect to a motor stator 7a. In order that upon horizontal movement of the crankshaft 6, an end surface of a crank portion 6a of the crankshaft 6 can contact that portion of a surface of an orbiting scroll end plate 2a exposed to an orbiting bearing portion 30 and that a left-hand side (FIG. 5) of a thrust receiving portion 6b of the crankshaft will not contact with a flange 2d of the orbiting scroll 2, the two gaps. A gap between an end surface of a crank portion 6a of the crankshaft 6 and that portion of a surface of the orbiting scroll end plate 2a exposed to the orbiting bearing member 30, and a gap between a left-hand face (FIG. 5) of a thrust receiving portion 6b of the crankshaft 6 and a flange 2d of the orbiting scroll 2 are so determined that upon horizontal movement of the crankshaft 6, the end surface of the crank portion 6a can contact the surface of the orbiting scroll end plate 2a and that the left-hand face of the thrust receiving portion 6b will not contact the flange 2d.

As described above for the vertical-type scroll compressor, the crankshaft 6 is supported by the main bearing portion 31, provided on a main frame 3, and an auxiliary bearing portion 32 provided on an auxiliary frame 8, and the electric motor 7 is disposed between the two bearing portions 31 and 32. An inner surface of the auxiliary bearing portion 32 is formed into a bearing surface, and a spiral oil feed groove 32a is formed in this bearing surface. The auxiliary bearing portion 32 has a generally spherical outer surface, and is fitted in a housing of the auxiliary frame 8 having a generally spherical inner surface, with a small clearance formed therebetween, and has an aligning function. As described above for the vertical-type scroll compressor, the axis of the auxiliary bearing portion 32 is aligned with the axis of the main bearing portion 31 to be fixedly secured to an auxiliary frame support member 10 by a plurality of bolts. An oil feed pipe 21 is press-fitted in the auxiliary frame 8 to be in communication with an oil feed passage 22 through an end surface of the crankshaft 6 disposed adjacent to the auxiliary bearing portion 32. A lower end of the oil feed pipe 21 is immersed in the lubricating oil in a lubricating oil portion 13.

The operation of the scroll compressor of FIG. 5 will now be described. A mechanism for compressing a cooling medium gas is the same as described for the vertical-type scroll compressor, and thereof explanation thereof will be omitted here. However, the crankshaft 6 is supported horizontally, and the weight of this crankshaft is supported by the main bearing portion 31 and the auxiliary bearing portion 32. Since the motor rotor 7b is slightly offset toward the main bearing portion 31 with respect to the motor stator 7a, the crankshaft 6 is subjected to a magnetic thrust in a direction toward the auxiliary bearing portion 32. Because of this magnetic thrust, the crankshaft 6 is held in intimate sliding contact with a thrust bearing 34, formed at an end of the main bearing portion 31, during the operation. Even when the crankshaft 6 is horizontally moved in a transient condition as at the time of the activation, the end surface of the crank portion 6a of the crankshaft 6 contacts the surface 2g of the orbiting scroll end plate 2a, and therefore the flange 2d, held in sliding contact with a seal member 4 for the orbiting scroll 2, will not be damaged.

Because of the pressure differential between a discharge pressure and the pressure within a back pressure chamber, the lubricating oil is fed from the lubricating oil portion 13 to the oil feed passage 22 in the crankshaft 5 via the oil feed pipe 21, connected to the auxiliary frame 8, and a space immediately adjacent to the end surface of the auxiliary bearing portion 32 is exposed. The auxiliary bearing portion 32 is lubricated by the lubricating oil fed through the space, disposed immediately adjacent to the end surface of the auxiliary bearing portion 32, and the spiral groove 32a. The spiral groove 32a is so designed as to achieve a viscous pumping action in a direction to promote the lubrication upon the rotation of the crankshaft 6, and therefore the lubricating capacity is enhanced in the bearing surface.

The lubricating oil is supplied to the main bearing portion 31 and the orbiting bearing portion 30 is effected in the same manner as described above for the vertical-type scroll compressor, and therefore explanation thereof will be omitted here.

By virtue of the provision of the oil feed passages of the above construction in the above embodiments, the lubricating oil, kept at the discharge pressure due to the pressure differential, can be fed into the oil feed passage in the crankshaft in both the vertical-type and horizontal-type scroll compressors, and the lubricating oil is fed to the third oil feed passage branching off radially from the first oil feed passage in the crankshaft, so that the lubricating oil can be supplied to the main bearing portion 31 under increased pressure due to the centrifugal pumping action caused by the rotation of the crankshaft.

The oil feed passage, formed in the orbiting scroll, is open to the area of contact of the opposed surfaces of the end plates of the orbiting and stationary scrolls. With this construction, these sliding surfaces of the two end plates are lubricated due to the pressure differential. Further, the lubricating oil, after lubricating these portions, is discharged into the back pressure chamber, in which the Oldham ring is mounted, to thereby lubricate the sliding surface of the Oldham ring, and enters the compression chamber through the intermediate hole 2e, and is discharged together with the cooling medium gas, and is returned to the lubricating oil portion at the lower end portion of the closed vessel. In this manner, all of the sliding surfaces of the scroll compressors can be lubricated by the lubricating oil.

In the above embodiments, the pressure-differential lubrication and the centrifugal pumping lubrication are used in combination, and therefore the lubricating oil can be positively supplied to the sliding surfaces even during the low-speed operation (in a lubricating method depending only on a centrifugal pumping action, the pumping capacity is lowered during a low-speed operation), and the lubrication can be always effected during the operation in the scroll compressor of the variable speed type.

The lubricating oil is supplied to each of the bearing portions, using the pressure-differential lubrication and the centrifugal pumping lubrication in combination, while the lubricating oil is supplied to the surfaces of the end plates of the scrolls and so on, using only the pressure-differential lubrication. Thus, there are used the separate oil feed lines, and therefore the amount of feed of the oil to the bearing portions and the amount of feed of the oil to the end plates can be set or determined independently of each other, and a sufficient amount of the lubricating oil can be supplied to each of the sliding portions.

In the case of the horizontal-type scroll compressor, a lubricating oil could not be fed into an oil feed passage in a conventional crankshaft, and a lubricating method depending only on a centrifugal pumping action could not be used. In the present invention, however, the lubricating oil can be fed into the oil feed passage in the crankshaft by the pressure differential, and thus the lubrication can be effected, using the pressure differential and the centrifugal pumping action in combination, as in the vertical-type scroll compressor.

The oil feed passage in the crankshaft is eccentric toward the crank portion with respect to the axis of rotation of the crankshaft. With this construction, when the lubricating oil is flowing in the oil feed passage, the centrifugal pumping action is achieved to increase the pressure of the lubricating oil without the need of increasing the diameter of the crankshaft. Furthermore, the pressure of the lubricating oil in each radially-branching oil feed passage is increased thanks to the centrifugal pumping action, so that the lubricating oil can be positively supplied to each bearing portion.

In the present invention, the oil feed passage, formed longitudinally in the crankshaft, can be made larger in diameter than the radially-branching oil feed passages, and the centrifugal pumping action can be obtained with this larger-diameter portion, which further enhances the lubricating capacity.

In the above embodiments of the present invention, the following advantageous effects are achieved.

(1) There are provided the first and second oil feed passages which communicate the lubricating oil under the discharge pressure with the lower-pressure portion (for example, the back pressure chamber of the medium pressure), and further the third oil feed passage branches off radially from the oil feed passage, formed in the crankshaft, to reach the main bearing portion. Therefore, the lubricating oil can be supplied using the pressure-differential lubrication and the centrifugal pumping lubrication in combination, so that even during the low-speed operation, the lubricating oil is positively supplied to each sliding surface. Therefore, the stable lubrication can always be carried out even in the scroll compressor of the variable speed type.

(2) The lubrication depending on the pressure differential is used in combination, and therefore in the case of the horizontal-type scroll compressor, the lubricating oil can be fed into the oil feed passage in the crankshaft, and therefore there can be provided the lubricating construction using the pressure-differential lubrication and the centrifugal pumping lubrication in combination, so that the lubricating oil can be positively supplied even during the low-speed operation as in the vertical-type scroll compressor. As a result, the scroll compressor can be designed into a horizontal type, using main parts of the vertical-type scroll compressor. Therefore, the horizontal-type scroll compressor and the vertical-type scroll compressor can be manufactured using common production facilities and common main parts.

(3) The main bearing portion is lubricated by the centrifugal pumping lubrication while the surfaces of the end plates of the scrolls are lubricated by the pressure-differential lubrication. Thus, there are provided the separate lubricating lines, and therefore the amount of feed of the oil to the main bearing portion and the amount of feed of the oil to the end plate surfaces can be determined independently of each other, and a sufficient amount of the lubricating oil can be supplied to each sliding portion. This prevents each sliding surface from being overheated, and also prevents the performance of the scroll compressor from being lowered due to an excessive supply of the lubricating oil.

Figure 8:
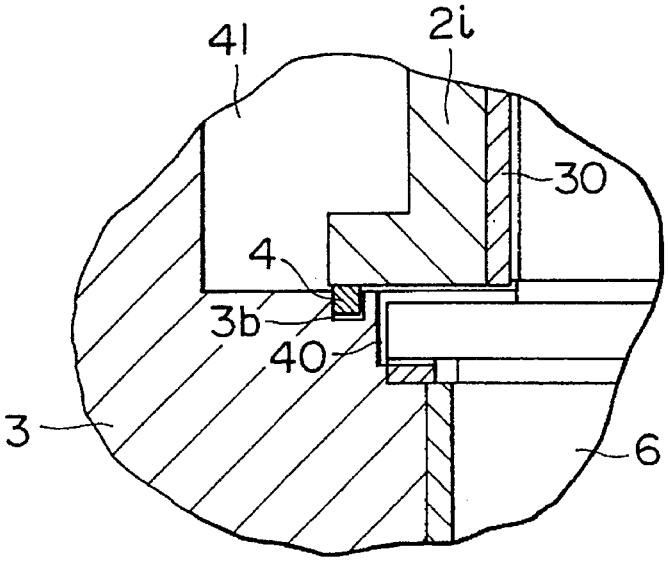
FIG. 8 is an enlarged, fragmentary view of a seal portion in the scroll compressor shown in FIG. 7.
Figure 7:
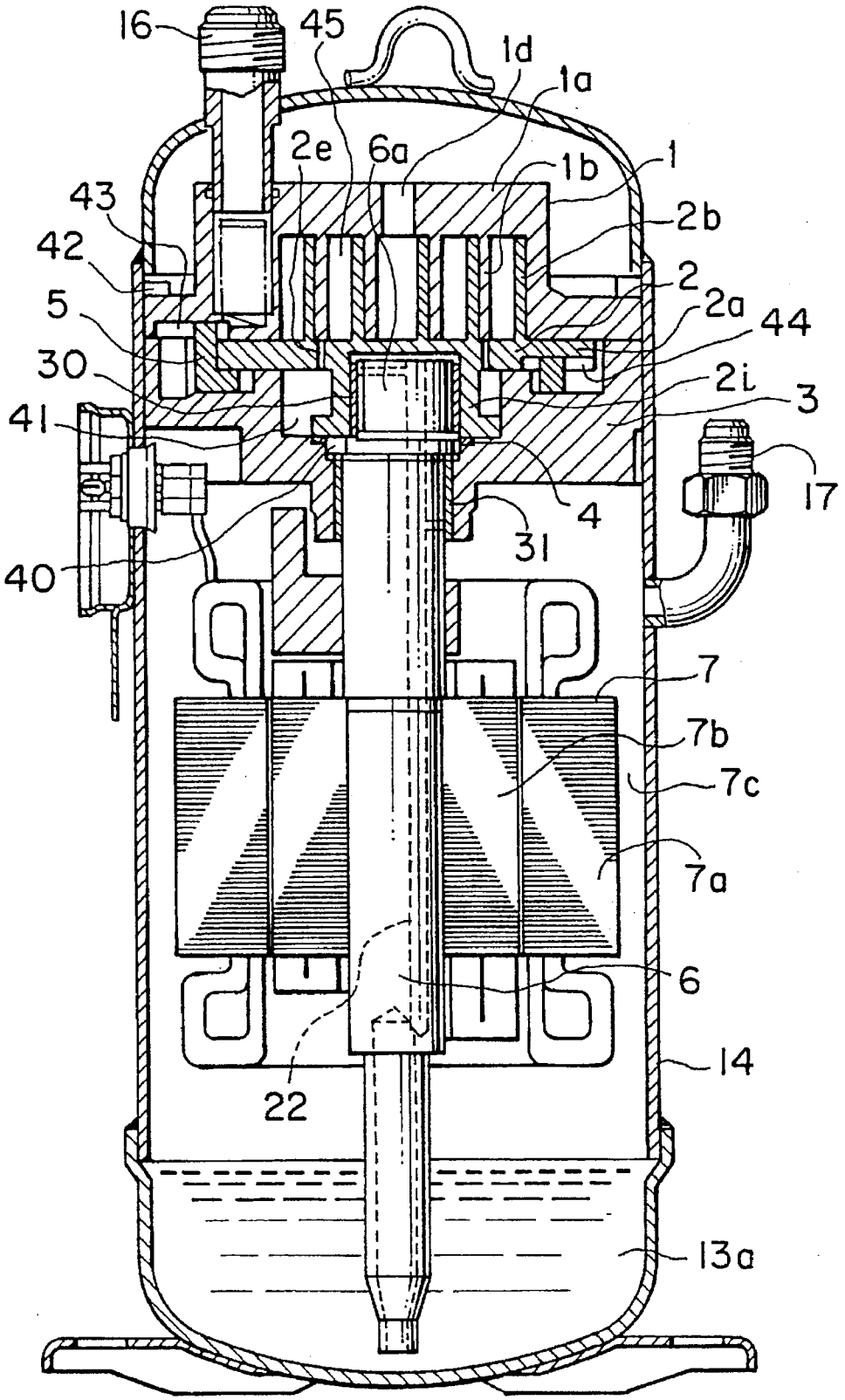
FIG. 7 is a vertical cross-sectional view of a further embodiment of a scroll compressor of the invention.

FIG. 7 shows an overall construction of a further embodiment of a scroll compressor of the present invention. FIG. 8 is an enlarged view of a portion of this scroll compressor.

A stationary scroll 1 includes a lap 1*b* of a spiral configuration provided upright on a mirror plate 1*a*, and an orbiting scroll 2 includes a lap 2*b* of a spiral configuration provided upright on a mirror plate 2*a*. The two scrolls 1 and 2 are connected together, with the laps 1*b* and 2*b* engaged with each other, and the orbiting scroll 2 is fixedly secured to a frame 3 by several bolts 42. The frame 3 has a back pressure chamber provided at a rear side of the orbiting scroll 2.

A stator 7*a* of an electric motor 7 is fixedly secured to an inner surface of a closed vessel 14, and a rotor 7*b* thereof is fixedly mounted on a crankshaft 6. A crank portion 6*a* is formed at an upper end of the crankshaft 6, and is fitted in a boss 2*i* formed on the orbiting scroll 2 at a central portion thereof.

An Oldham ring (rotation prevention member) 5 itself is well known, and therefore will be described briefly here. The Oldham ring 5 includes a ring portion and key portions, and the key portions are engaged respectively in at least one keyway 43, formed in an end surface of the stationary scroll 1, and at least one keyway 44 formed in the rear surface of the orbiting scroll 2. Instead of providing the keyway 43 in the stationary scroll 1, a keyway may be formed in the frame 3 as in a conventional construction.

A seal member 4 is provided between the frame 3 and an end surface of the boss 2*i* of the orbiting scroll 2, and divides the back pressure chamber into a first space 40 inside of the seal member 4 and a second space 41 at the outer peripheral portion of the frame 3. The seal member 4 seals the two spaces 40 and 41 with respect to the pressure. FIG. 8 shows this portion on an enlarged scale. A ring-shaped groove 3*b* is formed in the frame 3, and the seal member 4 is held in this ring-shaped groove 3*b*. The lower end surface of the boss 2*i* of the orbiting scroll 2 is formed into a sufficiently smooth surface, and the upper surface of the seal member 4 cooperates with the lower end surface of the boss 2*i* to seal the first and second spaces 40 and 41 in terms of pressure. The first space 40 is kept generally at a discharge pressure, and the second space 41 is kept at an intermediate pressure, and therefore the seal member 4 is subjected to an outwardly-directed force corresponding to the pressure differential. As described above in the above embodiments, the seal member 4 is in the form of a seal ring made, for example, of fluoroplastics or a polyimide resin, and the seal member 4 needs only to achieve a necessary sealing effect within the compressor during the operation. Although one seal member is shown, a plurality of seal members may be used in order to enhance the sealing effect.

When the rotor 7*b* of the electric motor 7 rotates, the crankshaft 6 connected to the rotor 7*b* rotates, and the orbiting scroll 2, fitted on the crank portion 6*a*, revolves, and a compression space 45, formed by the stationary scroll lap 1*b* and the orbiting scroll lap 2*b*, moves toward the center while decreasing in volume, thereby compressing a cooling medium gas drawn through an intake pipe 16. The compressed cooling medium gas is discharged into a space within the closed vessel 14 through a discharge port 1*d* formed in a central portion of the stationary scroll. The compressed gas thus discharged passes through gas passages (not shown) formed respectively in side or peripheral surfaces of the stationary scroll 1 and the frame 3, and flows into a space below the frame 3, and cools the electric motor 7, and then is fed via a discharge pipe 17 to a place where the compressed gas is to be used.

An oil feed passage 22 is formed in the crankshaft 6, and upon the rotation of the crankshaft 6, a lubricating oil 13*a*, held in a lower end portion of the closed vessel, is fed upwardly through the oil feed passage 22 by a centrifugal pumping action. The oil feed passage 22 is open to the space 40 of the back pressure chamber via an orbiting bearing portion 30 and a main bearing portion 31. The lubricating oil 13*a* of the discharge pressure flows into the first space 40, so that the first space 40 is kept at a pressure equal to or substantially equal to the discharge pressure. Therefore, a pressure gradient between the upper and lower end surfaces of the main bearing portion 31 is almost eliminated, and the cooling medium dissolved in the lubricating oil will not produce bubbles due to the reduction of the pressure, so that a high bearing reliability can be achieved.

A small proportion of the lubricating oil 13*a* having flowed into the first space 40 leaks into the second space 41 through the seal member 4 to lubricate the Oldham ring (rotation prevention member) 5 and other sliding portions, and is discharged into the compression space 45 through intermediate holes 2*e* of a small diameter. The remainder of the lubricating oil is discharged by gravity into the space within the closed vessel through clearances (gaps of the bearing or a cut portion in the surface of the crankshaft 6) of the main bearing portion 31.

On the other hand, the second space 41 of the back pressure chamber communicates with the compression space 45 through the small holes 2*e* formed in the mirror plate 2*a* of the orbiting scroll 2, and the second space 41 is kept at an intermediate pressure intermediate the discharge pressure and the suction pressure. By suitably determining the positions of these small holes 2*e*, as well as the pressure of the compression space 45, the pressure (medium pressure) within the second space 41 is adjusted to such a level as to apply a pressing force to the rear surface of the orbiting scroll 2 against a force tending to separate the two scrolls from each other. Since the lubricating oil is not included in the compressed gas, there is no need to separate the oil from the discharge gas, and a level of oil shortage is kept to a low level.

Figure 9:
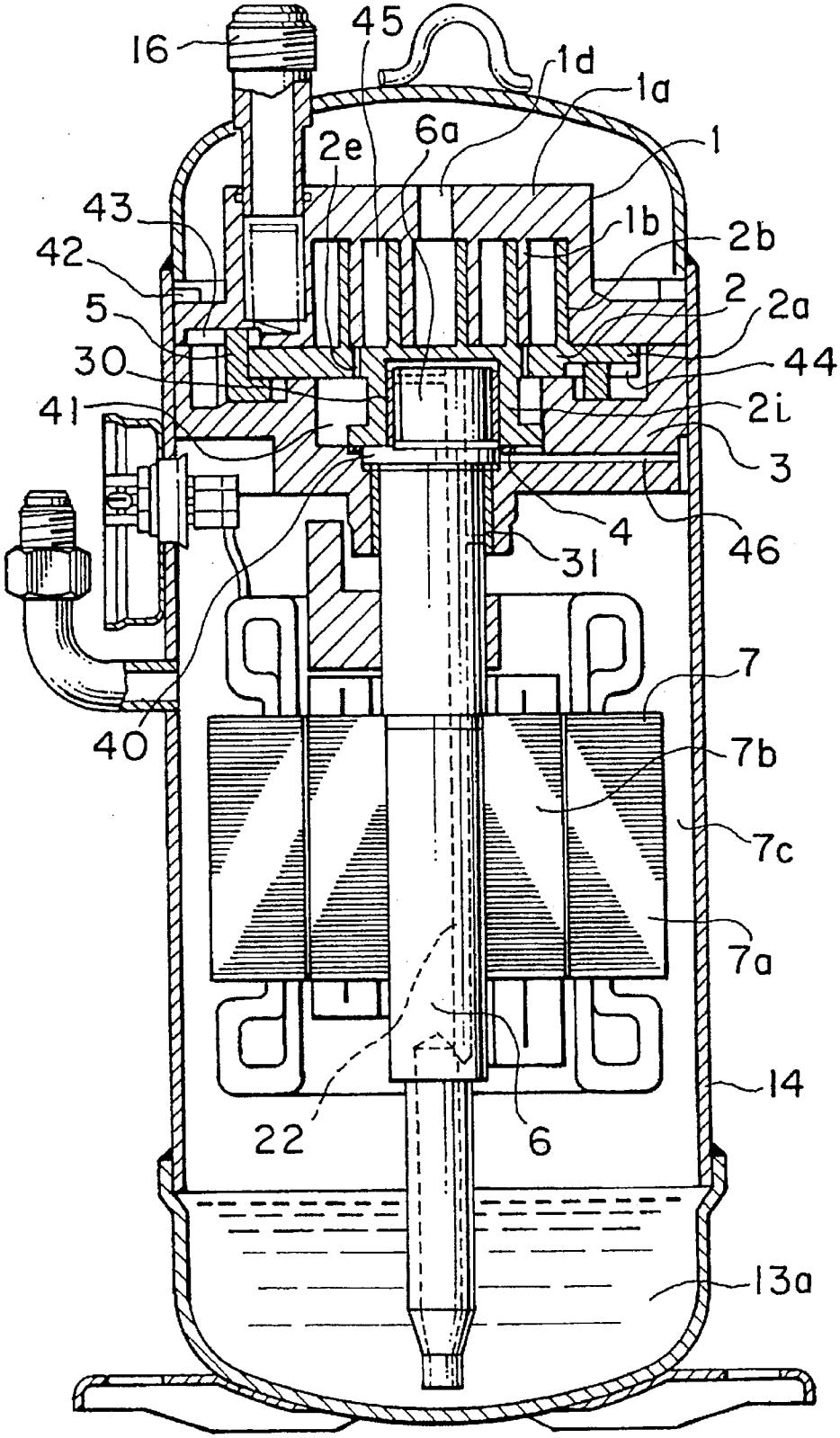
FIG. 9 is a vertical cross-sectional view of a modified form of the scroll compressor shown in FIG. 7.

FIG. 9 shows a modified form of the scroll compressor of FIG. 7. A scroll compressor of this embodiment differs from the scroll compressor of FIG. 9 in that there is provided an oil discharge passage 46 which is open to a first space 40 of a back pressure chamber, and communicates with a space in a closed vessel 14. A pressure head of a centrifugal pump for feeding a lubricating oil 13*a* into the first space 40 is set to a level higher than the minimum head necessary for positively raising the lubricating oil 13*a* to an upper end of a crankshaft 6, and by doing so, the pressure within the first space 40 is slightly higher than a discharge pressure, so that the lubricating oil 13*a*, having flowed into the first space 40, can be positively discharged into the space in the closed vessel 14 through the oil discharge passage (hole) 46.

The lubricating oil is thus positively discharged from the first space 40, so that only a very small amount of the lubricating oil will leak from the first space 40 into a second space 41. Therefore, the high-temperature lubricating oil will not pass through small holes 2*e* in an orbiting scroll 2, and hence will hardly be included in compression gas in the course of compression. Therefore, the compressed gas will hardly be raised, thus preventing the compression efficiency from being lowered.

Since the lubricating oil will not be included in the compressed gas, there is no need to separate the oil from the discharge gas, and a level of oil shortage is kept to a low level.

Figure 10:
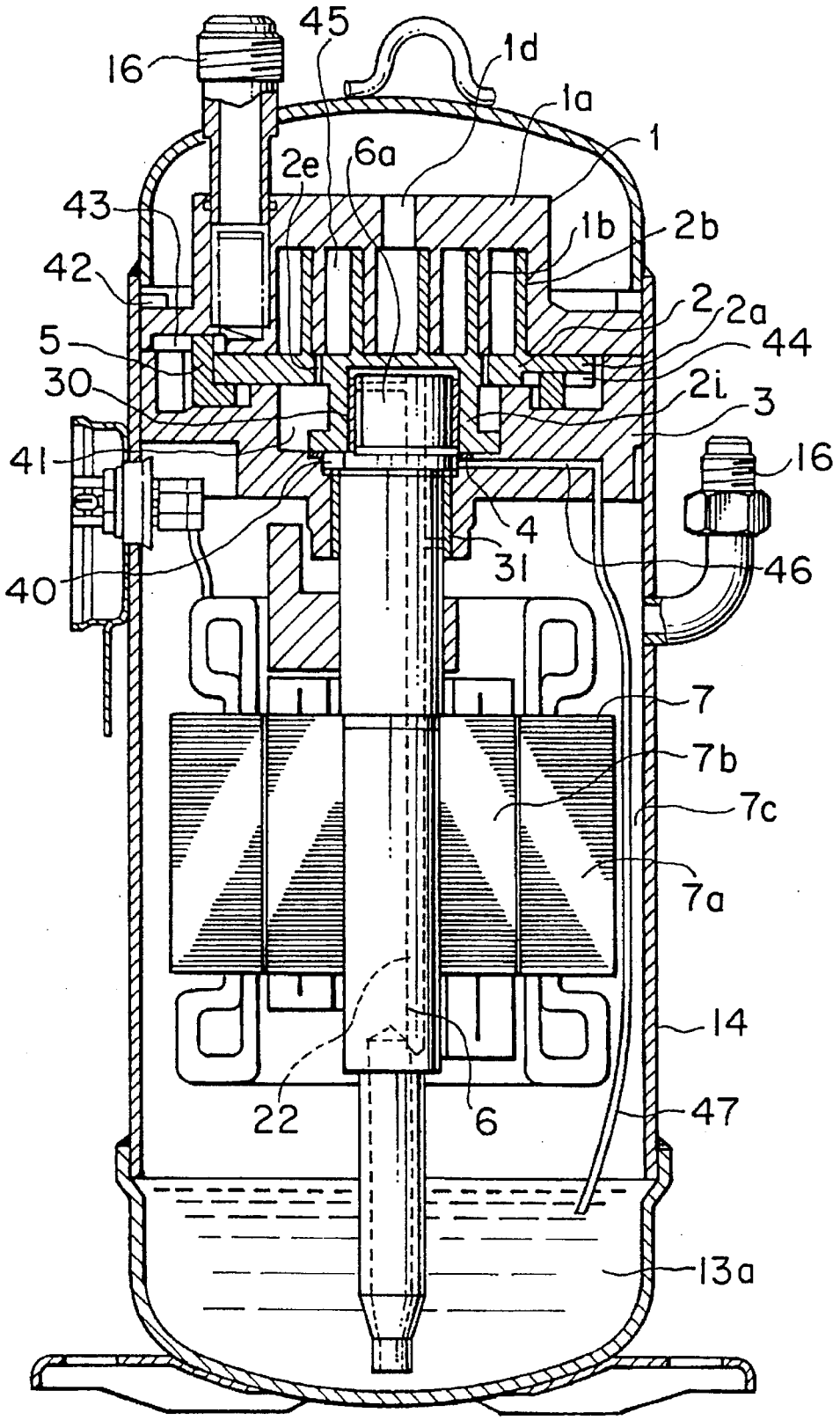
FIG. 10 is a vertical cross-sectional view of another modified form of the scroll compressor shown in FIG. 7.
Figure 11:
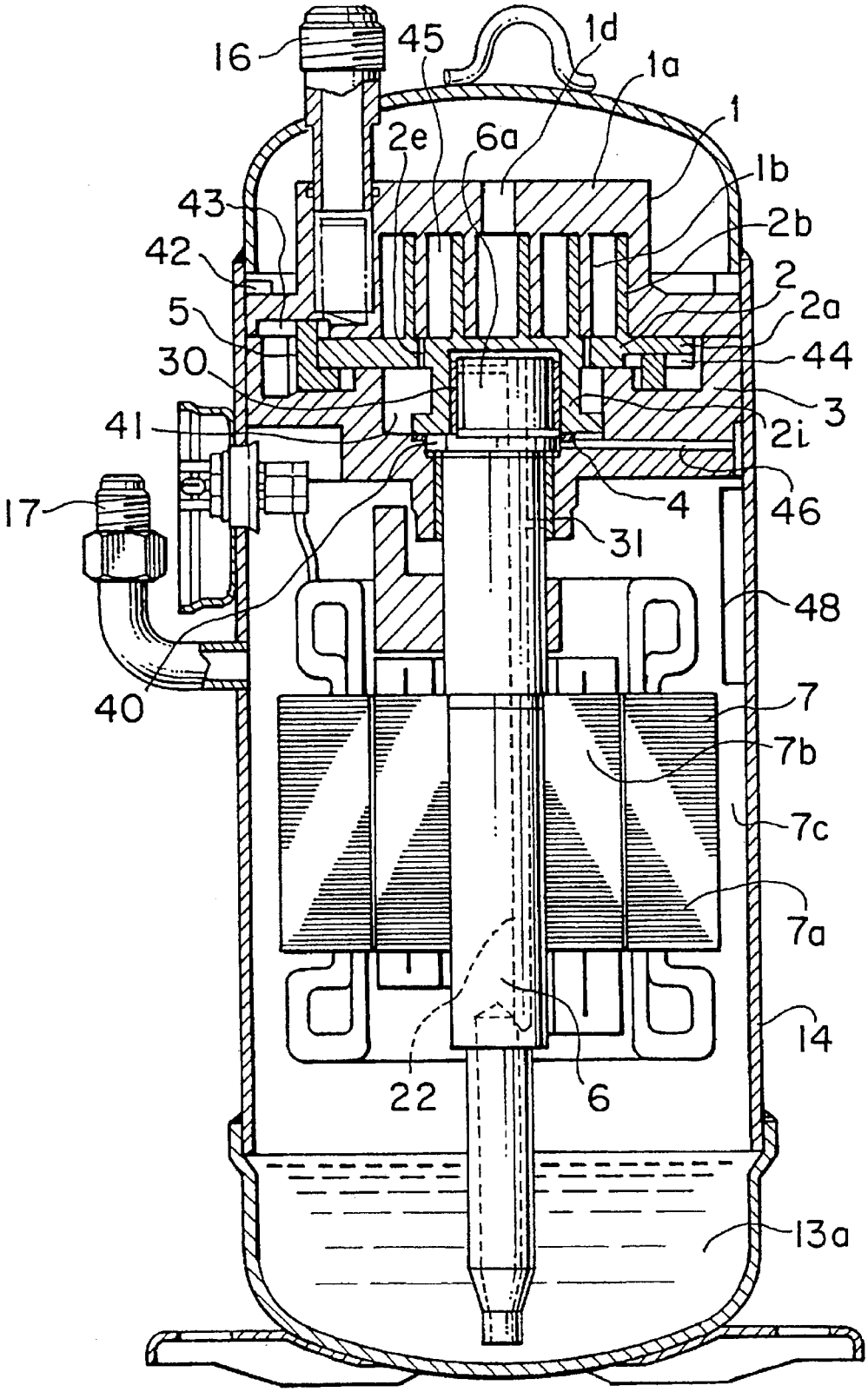
FIG. 11 is a vertical cross-sectional view of a further modified form of the scroll compressor shown in FIG. 7.

FIGS. 10 and 11 show modified forms of the scroll compressor of FIG. 7, respectively. Scroll compressors of FIGS. 10 and 11 are both so designed that a lubricating oil 13*a*, discharged from an oil discharge passage 46 into a space in a closed vessel 14, will not be included in a flow of discharge gas in the closed vessel 14.

In the scroll compressor of FIG. 10, a discharge pipe 47 is connected at one end thereof to the discharge passage 46 to be opened at the other end thereof to a lower end portion of the closed vessel 14. The discharge pipe 47 is mounted through a cut portion 7*c* formed in a surface of an electric motor 7. With this construction, the lubricating oil, discharged from a first space 40 of a back pressure chamber into the discharge passage 46, can be positively returned to an oil reservoir at the lower end portion of the closed vessel 14 without being mixed in the flow of discharge gas. In the scroll compressor of FIG. 11, a partition plate 48 for interrupting a flow of discharge gas is provided between one end of the oil discharge passage 46 opened to the space in the closed vessel 14 and a cut portion 7*c* formed in a surface of an electric motor 7, the partition plate 48 being mounted on an inner surface of the closed vessel 14. The partition wall 48 and the cut portion 7*c* of the electric motor 7 jointly constitute an oil guide passage.

In each of the embodiments of FIGS. 10 and 11, the flow of discharge gas in the space in the closed vessel 14 will not directly interfere with the discharge oil, and the discharge oil is prevented from being mixed in the discharge gas, so that a level of oil shortage can be kept to a low level.

Figure 15:
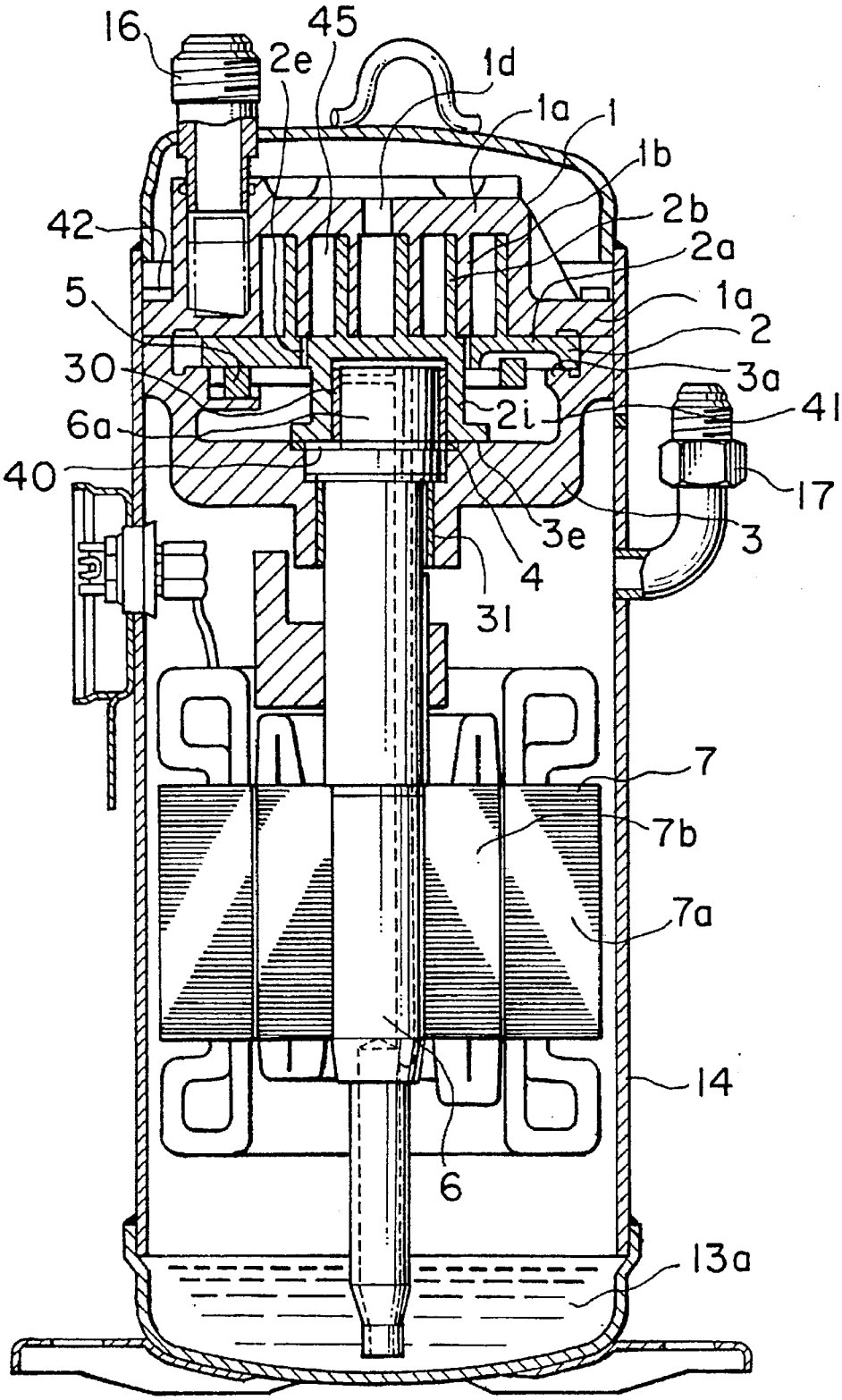
FIG. 15 is a vertical cross-sectional view of a further embodiment of a scroll compressor of the invention.

FIG. 15 shows a further modified form of the invention. In a conventional scroll compressor, an orbiting scroll 2 is supported in such a manner that its mirror plate 2*a* is held at its outer peripheral portion between an orbiting scroll support portion (pedestal) 3*a* of a frame 3 and an outer peripheral portion of a stationary scroll mirror plate 1*a*. In such a construction, a lower end surface of an orbiting scroll boss 2*i* and a bottom surface 3*e* of a space forming a back pressure chamber are used as seal surfaces, and the back pressure chamber can be divided into a first space 40 and a second space 41 by means of a seal member 4. Although a slide bearing is used in a main bearing portion 31, the back pressure chamber can be divided into two sections by the use of a roller bearing.

FIG. 15 shows the construction in which the embodiment of the present invention shown in FIG. 7 is applied to the conventional scroll compressor, and similarly this construction can be applied to the embodiments of FIGS. 9 to 11, and effects as described above can also be achieved.

Figure 12A:
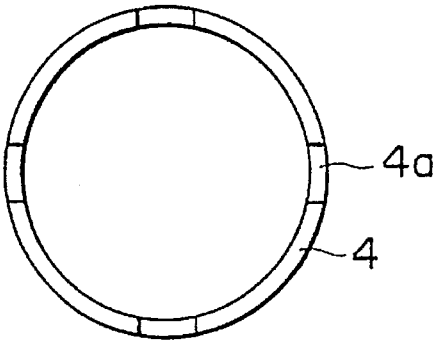
FIG. 12A & B is a view showing an example of a seal member used in the present invention.
Figure 12B:
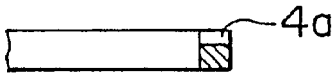
Figure 13A:
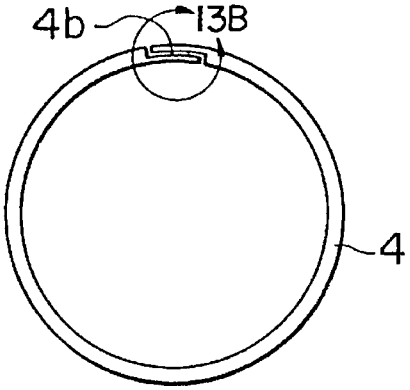
FIG. 13A & B is a view showing another example of a seal member used in the present invention.
Figure 13B:
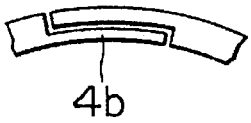

FIGS. 12 and 13 respectively show seal members 4 common to all of the above embodiments. In FIG. 12, grooves 4*a* are formed in an upper surface of the seal member 4. With this construction, a required amount of the lubricating oil 13*a* can be supplied through these grooves 4*a* to the sliding portions including the Oldham ring (rotation prevention member) 5 in the second space 41 of the back pressure chamber, and the mirror plates of the two scrolls 1 and 2. By suitably determining the number, width and depth of the grooves 4*a*, the amount of supply of the lubricating oil 13*a* can be adjusted. If the lubricating oil 13*a* leaks from the first space 40 of the back pressure chamber to the second space 41 through the upper surface of the seal member 4 in a sufficient amount, the grooves 4*a* do not need to be provided.

Figure 14:
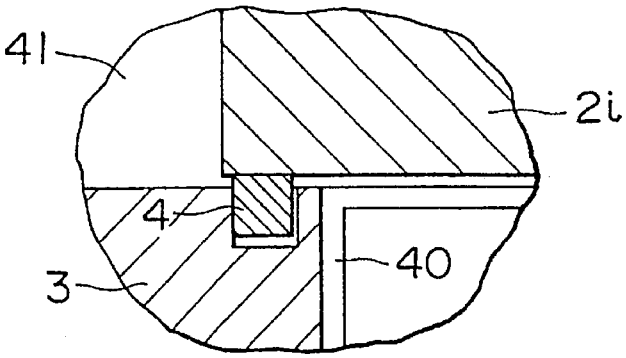
FIG. 14 is an enlarge view showing a seal portion in the scroll compressors of the invention.

In FIG. 13, a notch 4*b* is formed in the seal member 4. The first space inside of the seal member 4 is kept generally at the discharge pressure, and the second space outside of the seal member 4 is kept at the intermediate pressure intermediate the discharge pressure and the intake pressure. Therefore, because of the pressure differential, the seal member 4 is subjected to a generally radially outwardly-directed force to be deformed as shown in FIG. 14. Here, by forming the notch 4b in the seal member 4, the diameter of the seal member 4 can be suitably adjusted upon deformation due to the pressure differential without adversely affecting the sealing effect of the seal member 4. Therefore, the outer peripheral surface of the seal member 4 forms a good seal.

As described above, in the present invention, the orbiting scroll is supported by the intermediate pressure within the back pressure chamber, and the back pressure chamber is divided into the first space (i.e., central portion) generally at the discharge pressure, into which the lubricating oil flows, and the second space (i.e., outer peripheral portion) at the intermediate pressure, and the lubricating oil will not flow into the second space. With this construction, there can be achieved the scroll compressor in which the reliability is high, the lubricating oil is prevented from being mixed in the compression gas being compressed, thus preventing the efficiency from being lowered, and the amount of inclusion of the lubricating oil in the discharge gas (that is, a level of oil shortage) is small.

What is claimed is:

1. In a scroll compressor including a compression mechanism comprising a stationary scroll, an orbiting scroll, a crankshaft for revolving said orbiting scroll, and a main frame supporting said crankshaft through a main bearing portion, and a closed vessel containing said compression mechanism therein, adapted to be kept at a discharge pressure, and having a lubricating oil portion, the improvement comprising a first oil feed passage extending from said lubricating oil portion under said discharge pressure to a space, disposed adjacent to a distal end of a crank portion of said crankshaft, through said crankshaft;

a second oil feed passage extending from said space to a lower pressure portion through an end plate of said orbiting scroll, and having a throttle portion of a reduced flow passage area at sliding portions of said end plate of said orbiting scroll and an end plate of said fixed scroll; and a third oil feed passage extending from midway said first oil feed passage to be opened to an outer peripheral surface of said crankshaft, and serving to supply a lubricating oil to said main bearing portion by the use of a centrifugal pumping action produced by the rotation of said crankshaft.

2. In a scroll compressor including a compression mechanism comprising a stationary scroll having a lap, an orbiting scroll having a lap, a compression chamber formed by engagement of said laps, a crankshaft for revolving said orbiting scroll through an orbiting bearing portion, and a main frame supporting said crankshaft through a main bearing portion;

an electric motor portion for driving said compression mechanism, and a closed vessel containing said compression mechanism portion and said electric motor portion therein, adapted to be kept at a discharge pressure, and having a lubricating oil portion, the improvement comprising a first oil feed passage extending from said lubricating oil portion under said discharge pressure to a space, disposed adjacent to a distal end of a crank portion of said crankshaft, through said crankshaft; and a second oil feed passage extending from said space to be opened to sliding portions of end plates of said orbiting and stationary scrolls through the end plate of said orbiting scroll, and communicating with a lower pressure portion, said second oil feed passage having a throttle portion of a reduced flow passage area at said sliding portions of said end plates and said orbiting and stationary scrolls; and a third oil feed passage extending from midway said first oil feed passage to be opened to an outer peripheral surface of said crankshaft, and serving to supply a lubricating oil to said main bearing portion by the use of a centrifugal pumping action produced in accordance with the rotation of said crankshaft.

3. In a scroll compressor including a compression mechanism comprising a stationary scroll having an end plate and a lap of a spiral configuration provided upright on said end plate, an orbiting scroll having an end plate and a lap of a spiral configuration provided upright on said end plate, a compression chamber defined by engagement of said stationary scroll and said orbiting scroll with said laps inside, a crankshaft for revolving said orbiting scroll through an orbiting scroll bearing portion, and a main frame supporting said crankshaft through a main bearing portion, an electric motor portion for driving said compression mechanism, a closed vessel containing said compression mechanism and said electric motor portion therein, communicating with a discharge port of said compression mechanism to be kept at a discharge pressure, and having a lubricating oil portion provided at a lower end portion thereof, and a back pressure chamber defined by said orbiting scroll, said stationary scroll and said main frame to be disposed at a rear side of said orbiting scroll, and being kept at a pressure intermediate the discharge pressure and a suction pressure, the improvement comprising a seal member provided between said orbiting scroll and said main frame to isolate said back pressure chamber from said bearing portions, thereby keeping said bearing portions substantially under the discharge pressure;

a first oil feed passage extending from said lubricating oil portion under said discharge pressure to a space, disposed adjacent to a distal end of a crank portion of said crankshaft, through said crankshaft; and a second oil feed passage extending from said space to be opened to sliding portions of said end plates of said orbiting and stationary scrolls through the end plate of said orbiting scroll, and further communicating with said back pressure chamber, said second oil feed passage having a throttle portion of a reduced flow passage area at said sliding portions of said end plates and said orbiting and stationary scrolls; and a third oil feed passage extending from midway said first oil feed passage to be opened to an outer peripheral surface of said crankshaft, and serving to supply a lubricating oil to said main bearing portion by the use of a centrifugal pumping action produced in accordance with the rotation of said crankshaft.

4. A scroll compressor according to claim 3, in which said throttle portion is defined by sliding surfaces of said end plates of said orbiting scroll and said stationary scroll, to which the oil feed passage portion of said second oil feed passage formed in the end plate of said orbiting scroll is opened.

5. A scroll compressor according to claim 3 or claim 4, in which a groove passage is formed substantially circumferentially in that area of the sliding surface of said stationary scroll end plate, in which the open end of the oil feed passageway, formed in said orbiting scroll, moves upon the revolution of said orbiting scroll, so that said open end of said oil feed passage portion intermittently can communicate with said groove passage upon the revolution of said orbiting scroll.

6. A scroll compressor according to claim 3, in which an Oldham ring is provided in said back pressure chamber, and a sliding surface of said Oldham ring is lubricated by the lubricating oil supplied from said second oil feed passage due to a pressure differential.

7. A scroll compressor according to claim 3, in which said first oil feed passage formed in said crankshaft is inclined relative to an axis of said crankshaft in such a manner that it is disposed substantially in the axis of said crankshaft at its upstream side, and is eccentric from the axis of said crankshaft at its downstream side.

8. A scroll compressor according to claim 3, in which there is provided an auxiliary bearing portion which supports an end portion of said crankshaft opposite to said crank portion disposed adjacent to said main bearing portion, and there is provided a fourth oil feed passage which extends from midway said first oil feed passage to be opened to the outer peripheral surface of said crankshaft, and serving to supply the lubricating oil to said auxiliary bearing portion by the use of the centrifugal pumping action produced by the rotation of said crankshaft.

9. A scroll compressor according to claim 3, in which an oil discharge hole is formed in said main frame to communicate a first space, formed between said orbiting bearing portion and said main bearing portion, with a second space in said closed vessel so as to discharge the lubricating oil, supplied to said first space, to said second space in said closed vessel.

10. A scroll compressor according to claim 3, in which said first oil feed passage is provided with an oil feed pipe which connects an end of said oil feed passage portion formed in said crankshaft to said lubricating oil portion.

11. A scroll compressor according to claim 7, in which said first oil feed passage formed in said crankshaft is eccentric toward said crank portion with respect to the axis of said crankshaft.

12. In a scroll compressor of the horizontal type including a stationary scroll, an orbiting scroll, a horizontally extending crankshaft for revolving said orbiting scroll, a main frame supporting a portion of said crankshaft toward a crank through a main bearing portion, and a closed vessel containing said two scrolls, said crankshaft, said main frame and said main bearing portion therein, adapted to be kept at a discharge pressure, and having a lubricating oil portion, the improvement comprising an auxiliary bearing portion mounted on said closed vessel, and supporting an end portion of said crankshaft opposite to said crank portion;

a first oil feed passage extending from said lubricating oil portion under said discharge pressure to a space, disposed adjacent to a distal end of said crank, through an oil feed pipe, mounted on said closed vessel, and an oil feed passage portion formed in said crankshaft;

a second oil feed passage extending from said space to a lower pressure portion through an end plate of said orbiting scroll, and having a throttle portion of a reduced flow passage area at sliding portions of said end plate of said orbiting scroll and an end plate of said fixed scroll;

a third oil feed passage extending from midway said first oil feed passage to be opened to an outer peripheral surface of said crankshaft, and serving to supply a lubricating oil to said main bearing portion by the use of a centrifugal pumping action produced by the rotation of said crankshaft; and a fourth oil feed passage extending from midway said first oil feed passage to be opened to the outer peripheral surface of said crankshaft, and serving to supply the lubricating oil to said auxiliary bearing portion by the use of the centrifugal pumping action produced by the rotation of said crankshaft.

13. In a scroll compressor including a scroll compression mechanism housed in a closed vessel and comprising (i) an orbiting scroll having an end plate and a lap of a spiral configuration provided upright on said end plate, (ii) a stationary scroll having an end plate and a lap of a spiral configuration provided upright on said end plate, said orbiting scroll and said stationary scroll being engaged with their laps engaged with each other to form a compression space, and (iii) a frame fixedly secured to said stationary scroll to surround said orbiting scroll, said orbiting scroll being moved relative to said stationary scroll to centrally move said compression space to reduce a volume of said compression space, said closed vessel being communicated to a discharge port to be kept at a discharge pressure, a back pressure chamber being formed by said orbiting scroll, said stationary scroll and said frame to be disposed on an opposite side of said orbiting scroll to said lap thereof;

the improvement comprising at least one seal member provided between said orbiting scroll and said frame to divide said back pressure chamber into a first space disposed at a central portion and a second space disposed at an outer peripheral portion of said back pressure chambers, said first space being kept at a pressure substantially equal to said discharge pressure, said second space being kept at a pressure intermediate a suction pressure and said discharge pressure, and said second space communicating through at least one communication passage with said compression space formed by said two scrolls during the compressing operation.

14. A scroll compressor according to claim 13, in which an oil feed passage is formed in a main shaft to be opened to said first space so as to feed a lubricating oil, stored in a bottom portion of said closed vessel, into said first space, there being provided an oil discharge passage for discharging the lubricating oil from said first space into a space in said closed vessel.

15. A scroll compressor according to claim 14, in which an oil discharge pipe is provided on said oil feed passage to be connected to said oil discharge passage so as to rapidly return the lubricating oil to the bottom portion of said closed vessel.

16. A scroll compressor according to claim 14, in which a partition plate for shutting off a flow of gas in the closed vessel is provided on an inner wall of said closed vessel at such a position that an open end of said oil discharge passage is directed toward said partition wall, thereby forming a guide passage for guiding the lubricating oil to the bottom portion of said closed vessel.

17. A scroll compressor according to claim 13, in which a rotation prevention member in the form of an Oldham ring is provided in said second space at the outer peripheral portion of said back pressure chamber.

* * * * *